US009974356B2

(12) United States Patent
Foxen

(10) Patent No.: US 9,974,356 B2
(45) Date of Patent: May 22, 2018

(54) ARTICLE OF FOOTWEAR WITH MIDSOLE WITH ARCUATE UNDERSIDE CAVITY INSERT

(71) Applicant: NIKE, Inc., Beaverton, OR (US)

(72) Inventor: Thomas Foxen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 202 days.

(21) Appl. No.: 14/811,595

(22) Filed: Jul. 28, 2015

(65) Prior Publication Data

US 2016/0037857 A1 Feb. 11, 2016

Related U.S. Application Data

(60) Provisional application No. 62/034,049, filed on Aug. 6, 2014.

(51) Int. Cl.
*A43B 13/12* (2006.01)
*A43B 13/42* (2006.01)
(Continued)

(52) U.S. Cl.
CPC ..... *A43B 13/125* (2013.01); *A43B 5/00* (2013.01); *A43B 7/144* (2013.01); *A43B 7/1405* (2013.01);
(Continued)

(58) Field of Classification Search
CPC ..... A43B 13/125; A43B 7/144; A43B 5/00; A43B 7/1405; A43B 7/1425; A43B 13/20;
(Continued)

(56) References Cited

U.S. PATENT DOCUMENTS 3,918,181 A * 11/1975 Inohara ..... A43B 5/00 36/129
4,494,321 A * 1/1985 Lawlor ..... A43B 5/06 36/25 R
(Continued)

FOREIGN PATENT DOCUMENTS

EP 0766932 A1 4/1997

OTHER PUBLICATIONS

International Search Report and the Written Opinion for Application No. PCT/US2015/042647, dated Oct. 26, 2015, 15 pages.
(Continued)

*Primary Examiner* — Ted Kavanaugh
(74) *Attorney, Agent, or Firm* — Honigman Miller Schwartz and Cohn LLP; Matthew H. Szalach; Jonathan P. O'Brien

(57) ABSTRACT

An article of footwear may include an upper and a sole structure secured to the upper, the sole structure including a midsole with an outsole secured thereto, wherein one or more arcuate inserts within recesses or cavities extending into the midsole are exposed through one or more apertures in the outsole. These inserts provide unique cushioning and support properties, particularly during "banking" (e.g., leaning to one side or pushing off to the side from the medial or lateral side of the foot). The inserts provide the structural benefits of dome or arch shapes that are formed in the mid-sole and open to the underside.

30 Claims, 28 Drawing Sheets

(51) Int. Cl.

| | |
|---|---|
| ***A43B 5/00*** | (2006.01) |
| ***A43B 7/14*** | (2006.01) |
| ***A43B 13/14*** | (2006.01) |
| ***A43B 13/18*** | (2006.01) |
| ***A43B 13/20*** | (2006.01) |

(52) U.S. Cl.
CPC ..... *A43B 7/1425* (2013.01); *A43B 7/1445* (2013.01); *A43B 7/1485* (2013.01); *A43B 13/14* (2013.01); *A43B 13/146* (2013.01); *A43B 13/181* (2013.01); *A43B 13/20* (2013.01); *A43B 13/42* (2013.01)

(58) Field of Classification Search
CPC ..... A43B 13/42; A43B 7/1485; A43B 13/14; A43B 13/146; A43B 13/181; A43B 7/1445
USPC ..... 36/103, 28, 29, 35 R, 35 B, 37, 38
See application file for complete search history.

(56) References Cited

U.S. PATENT DOCUMENTS 4,918,838 A * 4/1990 Chang ..... A43B 1/0018 36/28
5,224,279 A * 7/1993 Agnew ..... A43B 13/12 36/30 R
5,280,680 A 1/1994 Burke et al.
5,561,920 A * 10/1996 Graham ..... A43B 13/181 36/27
5,625,963 A * 5/1997 Miller ..... A43B 7/1495 36/114
5,642,575 A 7/1997 Norton et al.
5,653,046 A 8/1997 Lawlor
6,006,450 A * 12/1999 Hayes ..... A43B 5/00 36/107
6,212,795 B1 * 4/2001 Nakabe ..... A43B 7/18 36/107
6,467,197 B1 * 10/2002 Mitsui ..... A43B 13/36 36/28
6,477,792 B2 * 11/2002 Sartor ..... A43B 13/383 36/28
6,694,642 B2 * 2/2004 Turner ..... A43B 13/143 36/28
6,732,457 B2 5/2004 Gardiner
6,880,267 B2 * 4/2005 Smaldone ..... A43B 1/0072 36/28
7,178,267 B2 * 2/2007 Skaja ..... A43B 13/181 36/114
7,194,826 B2 3/2007 Ungari
7,426,792 B2 * 9/2008 Swigart ..... A43B 3/0031 36/28
7,434,337 B2 10/2008 Gibert et al.
7,748,143 B2 7/2010 Mathieu et al.
7,877,899 B2 * 2/2011 Nishiwaki ..... A43B 13/184 36/114
D634,524 S 3/2011 Pauk et al.
D634,922 S 3/2011 Pauk et al.
7,987,618 B2 8/2011 Nishiwaki et al.
8,074,377 B2 * 12/2011 Nishiwaki ..... A43B 7/142 36/25 R
8,151,485 B2 4/2012 Hurd et al.
8,166,673 B2 * 5/2012 Sills ..... A43B 1/0072 36/29
8,225,533 B2 * 7/2012 Meschan ..... A43B 13/186 36/27
8,863,407 B2 * 10/2014 Nishiwaki ..... A43B 5/06 36/25 R
9,015,962 B2 * 4/2015 Boudreau ..... A43B 13/141 36/25 R
9,433,256 B2 * 9/2016 Callahan ..... A43B 3/0057
9,504,293 B2 * 11/2016 Tsang ..... A43B 13/26
9,596,906 B2 * 3/2017 Lee ..... A43B 13/14
9,622,540 B2 * 4/2017 Keating ..... A43B 13/12
2001/0054242 A1 * 12/2001 Miller, II ..... A43B 5/001 36/127
2002/0050077 A1 * 5/2002 Wang ..... A43B 1/0072 36/28
2002/0092202 A1 * 7/2002 Masseron ..... A43B 13/184 36/28
2002/0116842 A1 * 8/2002 Meschan ..... A43B 3/0042 36/25 R
2003/0024134 A1 * 2/2003 Howlett ..... A43B 13/181 36/43
2003/0061733 A1 * 4/2003 Karsten ..... A43B 13/181 36/43
2003/0079373 A1 * 5/2003 Geer ..... A43B 1/0081 36/3 B
2003/0131496 A1 * 7/2003 Nakano ..... A43B 7/06 36/3 B
2004/0148803 A1 * 8/2004 Grove ..... A43B 13/223 36/103
2006/0137228 A1 * 6/2006 Kubo ..... A43B 3/0036 36/103
2007/0119076 A1 * 5/2007 Brewer ..... A43B 7/06 36/30 R
2007/0240331 A1 * 10/2007 Borel ..... A43B 13/026 36/28
2008/0127522 A1 * 6/2008 Crowley ..... A43B 5/00 36/105
2008/0289221 A1 * 11/2008 Munns ..... A43B 13/026 36/89
2009/0139114 A1 6/2009 Malek
2009/0172971 A1 * 7/2009 Peikert ..... A43B 7/125 36/88
2010/0251565 A1 * 10/2010 Litchfield ..... A43B 13/12 36/28
2011/0146110 A1 6/2011 Geer
2011/0277351 A1 11/2011 Scoledes
2012/0233887 A1 9/2012 Baker et al.
2015/0157088 A1 * 6/2015 Seo ..... A43B 1/0018 36/25 R
2015/0223564 A1 * 8/2015 Peyton ..... A43B 13/20 36/29
2015/0327624 A1 * 11/2015 Grott ..... A43B 7/14 36/91

OTHER PUBLICATIONS

State Intellectual Property Office, Notification of First Office Action and Search Report for CN Application No. 201580048313.7, dated Feb. 2, 2018.

* cited by examiner

ARTICLE OF FOOTWEAR WITH MIDSOLE WITH ARCUATE UNDERSIDE CAVITY INSERT

CROSS-REFERENCE TO RELATED APPLICATION

This non-provisional U.S. Patent Application claims priority under 35 U.S.C. § 119(e) to provisional U.S. Patent Application Ser. No. 62/034,049, which was filed in the U.S. Patent and Trademark Office on Aug. 6, 2014 and entitled Article Of Footwear With Midsole With Arcuate Underside Cavity Insert, such provisional U.S. Patent Application being entirely incorporated herein by reference.

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace may be utilized to modify the dimensions of the void and secure the foot within the void.

The sole structure is located adjacent to a lower portion of the upper and is generally positioned between the foot and the ground. In many articles of footwear, including athletic footwear, the sole structure generally incorporates an insole, a midsole, and an outsole. The insole, which may be located within the void and adjacent to a lower surface of the void, is a thin compressible member that enhances footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

Generally, the midsole is the primary source of cushioning for the article of footwear, and it is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and the upper, located between the midsole and the outsole, embedded within the midsole, or encapsulated by the foamed polymer material of the midsole, for example. Although many midsoles are primarily formed from a foamed polymer material, fluid-filled chambers or other non-foam structures may form a majority of some midsole configurations.

Midsoles tend to optimize support and cushioning comfort for a wearer when walking or running. The forces acting on the midsole during these activities tend to be directed vertically and in a forward and aft direction relative to the article of footwear. Midsoles are designed to return predictable and consistent cushioning comfort and support when encountering these forces.

Side-to-side or "banking" movement, particularly among athletes like football, basketball and tennis players, is also common. Usually, it is desirable for athletes to quickly change his or her side-to-side direction when banking. Accordingly, many athletes prefer more stable and supportive footwear with less cushioning during these banking maneuvers. However, footwear, and in particular midsoles, tend to offer the same or a similar level of cushioning and support throughout the entire range of use of the footwear whether when walking, running or banking.

SUMMARY

Domes are arcuate, curved structures, often hemispherical with a half-circle cross-sectional shape, that offer unique physical properties. For example, roofs incorporating domes may be particularly strong, and can support themselves without any support structures underneath. This strength property often allows the roofs to support immense additional weight. While this property is provided by domes having a half-circle cross-sectional shape, it may also be provided by a dome having a cross-sectional shape that is not a half-circle but is otherwise curved or arcuate.

The benefits of domes can be imparted to articles of footwear 10 by forming a dome in a midsole. More particularly, a midsole may be formed to incorporate an arcuate upwardly-extending recess, and an arcuate insert may be placed within the recess. This insert may in turn provide unique cushioning and support properties similar to the structural benefits of domes and arches.

The support properties provided by domed or arcuate inserts within recesses may be particularly advantageous during "banking" (e.g., leaning to one side or pushing off to the side from the medial or lateral side of the foot). The arched or dome shapes of the inserts may also provide structural support where it is desirable to limit cushioning.

In one embodiment, an article of footwear with a sole structure comprises a midsole with an arcuate underside recess, an arcuate insert element secured to the recess, and an outsole with an aperture. The insert element is exposed to an exterior of the footwear through the aperture, and the outsole is secured to the midsole in a region wholly surrounding the insert element.

In another embodiment, an article of footwear has an upper and a sole structure secured to the upper. The sole structure comprises a midsole, a plate, and a ground-engaging outsole. The midsole has an upper surface and an opposite lower surface. The upper surface is secured to the upper, and the lower surface defines an inwardly-extending arcuate recess. The plate is secured to the midsole and conforms to the recess. At least one opening extends through the plate to expose the midsole. An aperture extends through the outsole to expose the plate. The outsole is secured to the midsole in a region wholly surrounding the recess.

In yet another embodiment, an article of footwear has an upper and a sole structure secured to the upper. The sole structure comprises a midsole, an arcuate plate, and a ground-engaging outsole. The midsole is secured to the upper and has a lower surface defining an upwardly-extending underside recess. The plate is secured to the lower surface within the recess. The plate has a lower surface defining a protrusion. The outsole is secured to the midsole in a region wholly surrounding the recess. An aperture extends through the outsole to expose the plate.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

General Footwear Structure

The following discussion and accompanying figures disclose various configurations of sole structures. Concepts associated with the sole structures may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the sole structure may also be utilized with footwear styles that are generally considered to be non-athletic, including dress shoes, loafers, and sandals.

General Footwear Structure

Figure 1:
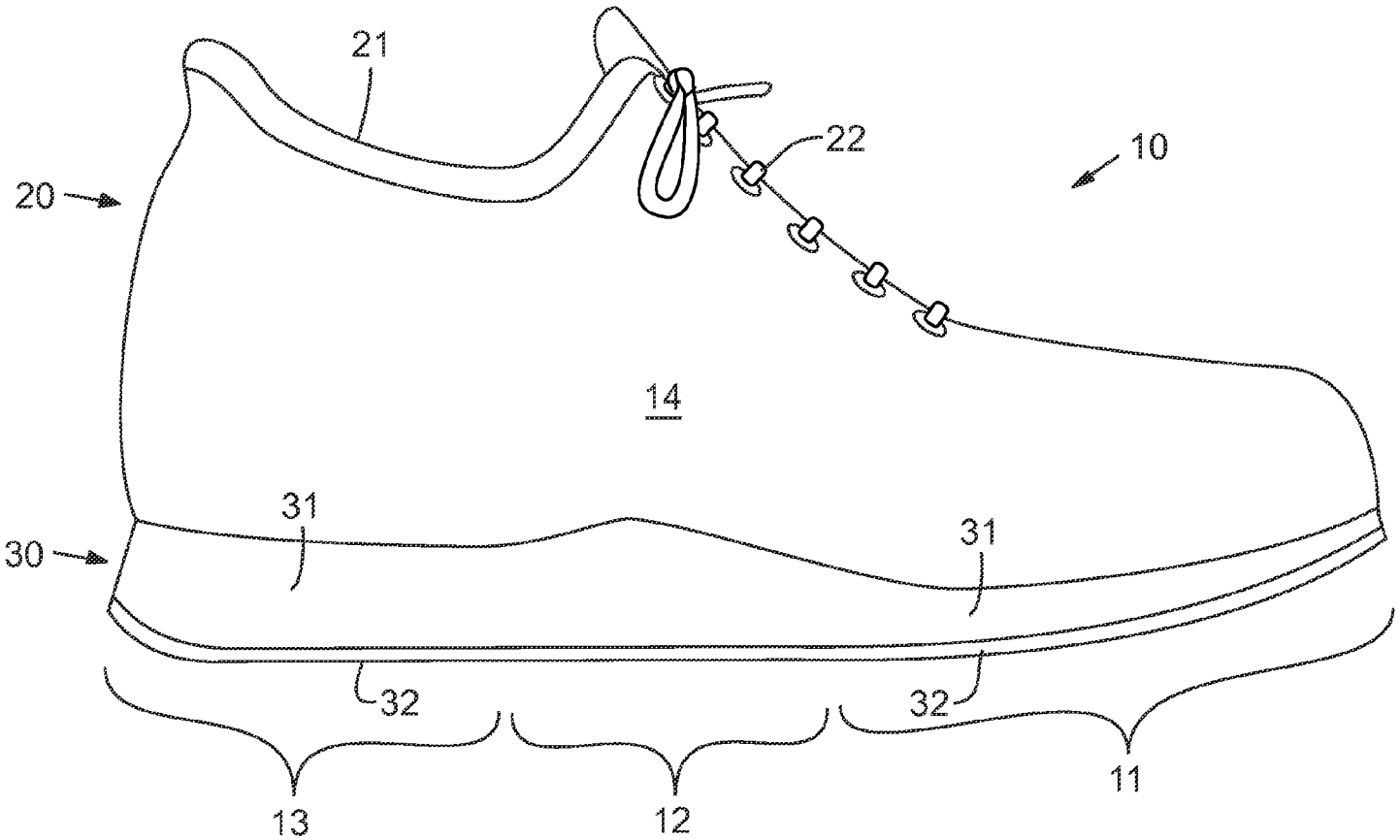
FIG. 1 is a lateral side elevational view of an article of footwear.
Figure 2:
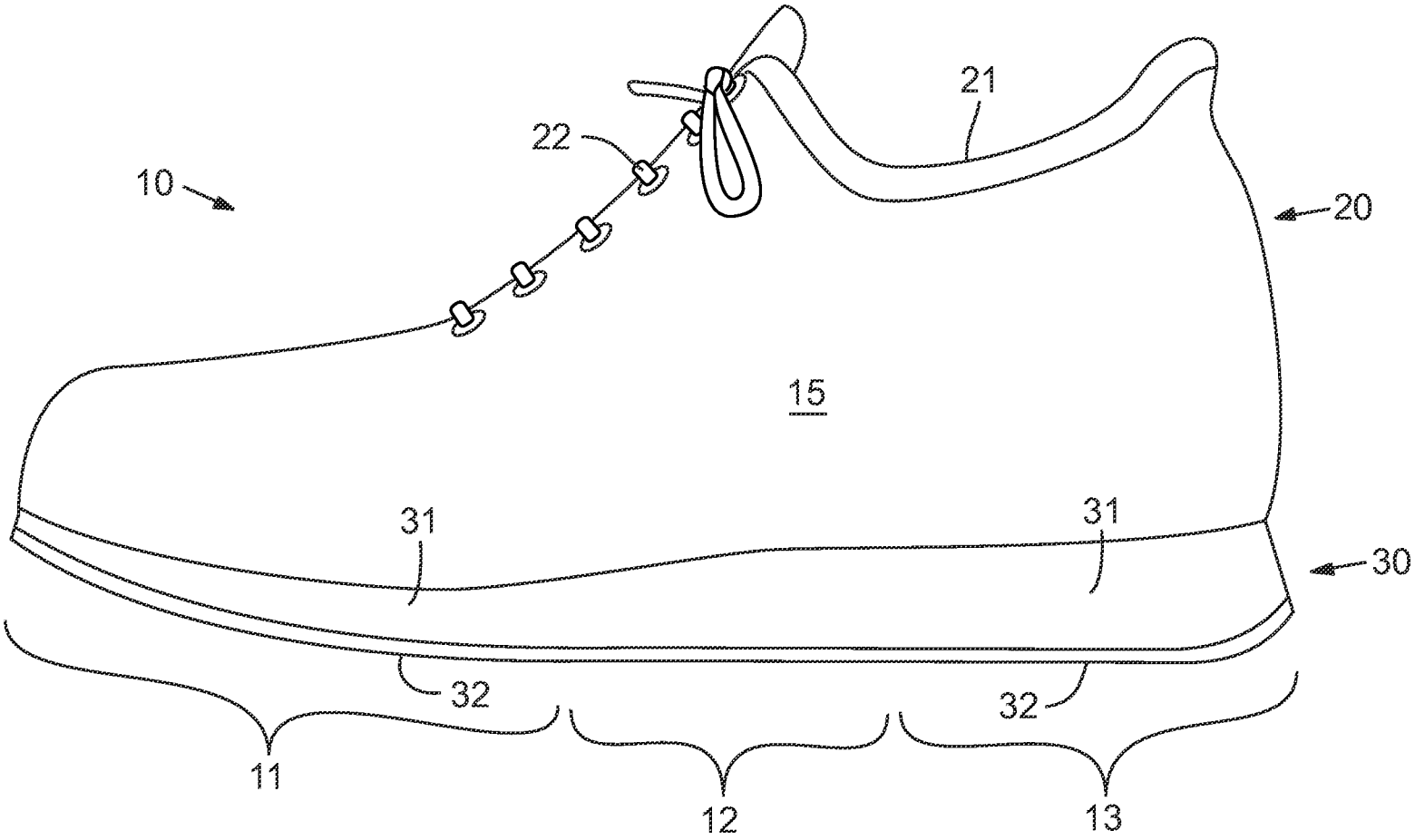
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIG. 1. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot. Heel region 13 generally includes portions of footwear 10 corresponding with rear portions of the foot, including the calcaneus bone. Lateral side 14 and medial side 15 extend through each of regions 11-13 and correspond with opposite sides of footwear 10.

Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be discussed with respect to the individual elements thereof, such as upper 20 and sole structure 30, and to the foot itself.

Upper 20 is depicted as having a substantially conventional configuration incorporating a variety of material elements (e.g., textile, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22.

Given that various aspects of the present application primarily relate to sole structure 30, upper 20 may exhibit the general configuration discussed above or the general configuration of practically any other conventional or non-conventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation.

The primary elements of sole structure 30 are a midsole 31 and an outsole 32. Midsole 31 may include a fluid-filled chamber. In addition, midsole 31 may incorporate one or more additional footwear elements that enhance the comfort, performance, or ground reaction force attenuation properties of footwear 10, including a polymer foam material, such as polyurethane or ethylvinylacetate, plates, moderators, lasting elements, or motion control members. Outsole 32, which may be absent in some configurations of footwear 10, is secured to a lower surface of midsole 31 and may be formed from a rubber material that provides a durable and wear-resistant surface for engaging the ground. In addition, outsole 32 may also be textured to enhance the traction (i.e., friction) properties between footwear 10 and the ground.

Sole structure 30 may also incorporate an insole or sockliner that is located within the void in upper 20 and adjacent (i.e., located nearby or close to, although not necessarily in contact with) a plantar surface or lower surface of the foot to enhance the comfort of footwear 10.

Midsole Dome Configuration

Domes are arcuate, curved structures, often hemispherical with a half-circle cross-sectional shape, that offer unique physical properties. For example, roofs incorporating domes may be particularly strong, and can support themselves without any support structures underneath. This strength property often allows the roofs to support immense additional weight. While this property is provided by domes having a half-circle cross-sectional shape, it may also be provided by a dome having a cross-sectional shape that is not a half-circle but is otherwise curved or arcuate.

Turning to FIGS. 3-6, an underside of midsole 31 is depicted as having upwardly-extending arcuate recesses 50. More particularly, midsole 31 has an upper surface secured to upper 20 and an opposite lower surface defining a first recess 52 and a second recess 54. Recesses 52 and 54 are spaced inward from an outer periphery 36 of midsole 31. First recess 52 is positioned on medial side 15 of forefoot region 11, while second recess 54 is positioned in heel region 13. Accordingly, as depicted, first recess 52 is a forefoot recess, and second recess 54 is a heel recess.

Meanwhile, apertures 40 are depicted as extending through outsole 32, i.e., as extending from an upper surface of outsole 32 to a lower surface of outsole 32. More particularly, outsole has a first aperture 42 and a second aperture 44, each of which is spaced inward from an outer periphery 37 of outsole 32. First aperture 42 is positioned on medial side 15 of forefoot region 11, while second aperture 44 is positioned in heel region 13. First aperture 42 and second aperture 44 are therefore a forefoot aperture and a heel aperture, respectively.

First recess 52 is exposed to an exterior of footwear 10 through first aperture 42. Meanwhile, outsole 32 is secured to midsole 31 in a bonded area that wholly surrounds first aperture 42 and is at least partially positioned in a complementary region 72 on medial side 15 of footwear 10. Similarly, second recess 54 is exposed to the exterior of footwear 10 through second aperture 44, and outsole 32 is secured to midsole 31 in a bonded area that wholly surrounds second aperture 44.

Although FIGS. 3-6 depict apertures 40 as exposing various recesses 50 in midsole 31, in various alternate configurations, apertures 40 may not expose all portions of recesses 50, and outsole 32 may instead extend partially or entirely across recesses 50. In some such configurations, recesses 50 may be interior portions of sole structure 30 in which the lower surface of midsole 31 is spaced from the upper surface of outsole 32. In other configurations, outsole 32 may conform to the lower surface of midsole 31, including recesses 50, and outsole 32 may thereby have arcuate shapes adjacent to recesses 50.

Returning to FIGS. 3-6, midsole 31 is also depicted as having an outer skin 60, portions of which are exposed through apertures 42 and 44. Specifically, a first skin 62 at first recess 52 and a second skin 64 at second recess 54 are both portions of outer skin 60 of midsole 31, first skin 62 being exposed through first aperture 42, and second skin 64 being exposed through second aperture 44. First skin 62 may therefore be a forefoot portion of outer skin 60, while second skin 64 may be a heel portion of outer skin 60.

Skin 62 has the arcuate shape of first recess 52 and skin 64 has the arcuate shape of second recess 54. Skins 62 and 64 thereby form domes on an underside of midsole 31. That is, skins 62 and 64 form arcuate, curved structures whose physical properties may provide weight-supporting benefits to midsole 31. Although there is less foamed polymer material above arcuate recesses 52 and 54 than above other areas of midsole 31, skins 62 and 64 may provide support to compensate from the foamed polymer material absent from recesses 52 and 54 without the need for other support or cushioning elements.

Outer skin 60 may form part or all of an outer surface of midsole 31, and the physical properties of outer skin 60 of midsole 31 may be different from the physical properties of inner portions of midsole 31. In some embodiments, outer skin 60 may be an outer portion of a resilient foamed polymer material of midsole 31, such as an outer portion formed by contact with a heated object like a mold. In such cases, outer skin 60 may be, or may include, a region of closed-cell polymer foam, while inner portions of midsole 31 may be an open-cell polymer foam. Outer skin 60 and inner portions of midsole 31 may thereby have different physical properties.

In other embodiments, outer skin 60 may be formed in part from a foamed polymer material of midsole 31 and in part from another material, such as an additive or a sealant, which may either physically combine with or chemically interact with the foamed polymer material of midsole 31. For example, outer skin 60 may be formed in part from a foamed polymer material of midsole 31, and in part from another material drawn into an outer portion of an open-cell polymer foam of midsole 31. As an alternate example, outer skin 60 may include a material formed by a chemical interaction between the polymer material of midsole 31 and another material. In such cases, whether formed by physical combination or by chemical reaction, outer skin 60 of midsole 31 may have different physical properties than inner portions of midsole 31 that have not combined physically with or reacted chemically with another material.

While midsole 31 is depicted in FIGS. 3-6 as including outer skin 60 and skins 62 and 64, some configurations of sole structure 30 may not include an outer skin. In such configurations, the foamed polymer material adjacent to recesses 50 may provide weight-supporting benefits to midsole 31, due to the domed or arcuate shape of recesses 50, while reducing the weight of midsole 31 itself.

As depicted, first recess 52 and second recess 54 extend upward into midsole 31 to a comparable degree. That is, recesses 52 and 54 have comparable heights. However, midsole 31 is depicted as having a greater thickness in heel region 13 than in forefoot region 11. The height of first recess 52 in comparison with the thickness of midsole 31 in forefoot region 11 is therefore proportionally greater than the height of second recess 54 in comparison with the thickness of midsole 31 in heel region 13. More particularly, a height of first recess 52 is greater than half of a thickness of midsole 31 in forefoot region 11, while a height of second recess 54 is less than half a thickness of midsole 31 in heel region 13.

In various configurations of footwear 10, however, the heights of arcuate recesses in midsole 31 may differ from the heights depicted in FIGS. 3-6. For example, first recess 52 and second recess 54 may have different heights, or may have heights proportional to the thickness of midsole 31 in each region. More generally, first recess 52 may have any height less than a thickness of midsole 31 in forefoot region 11, and second recess 54 may have any height less than a thickness of midsole 31 in heel region 13.

Figure 3:
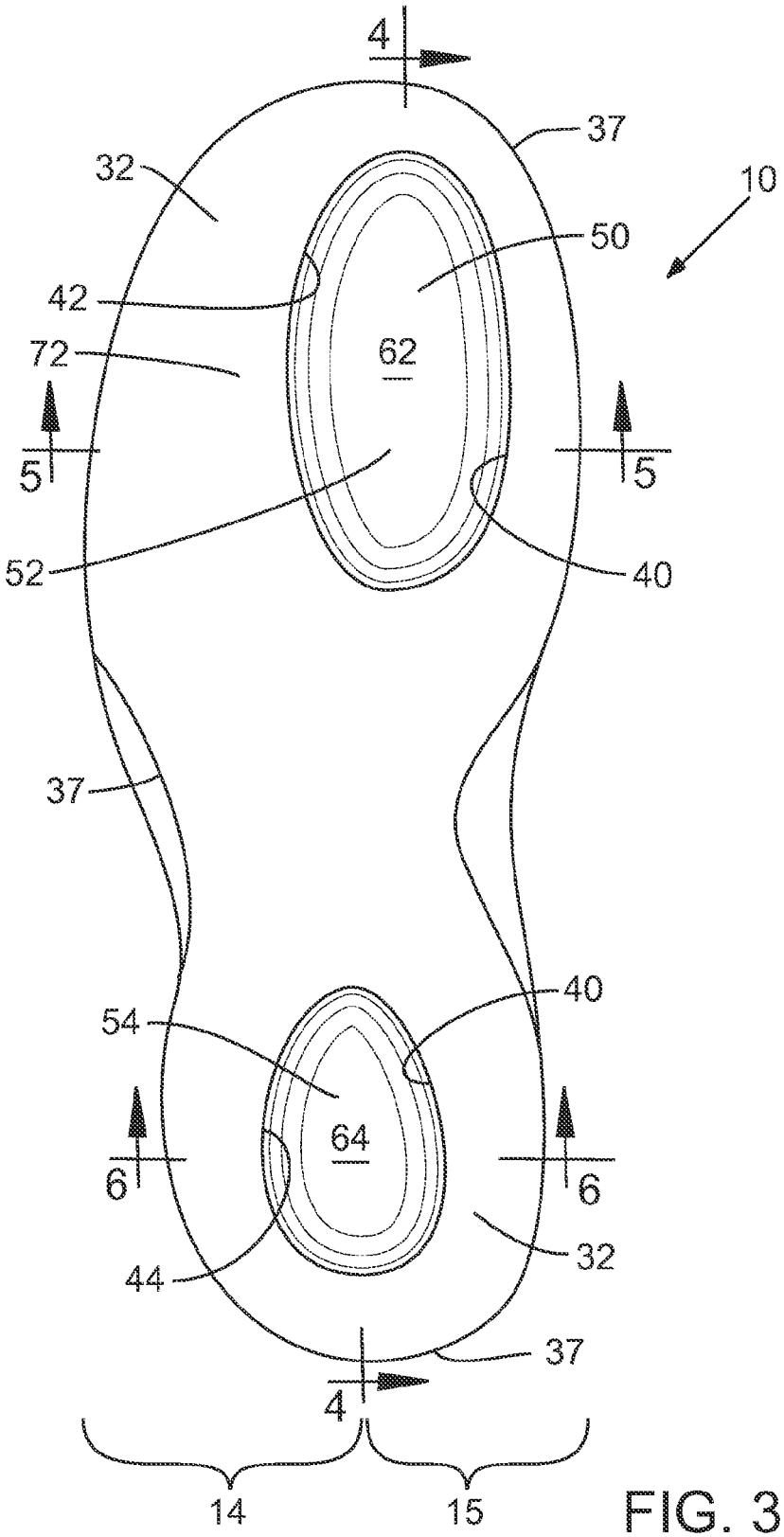
FIG. 3 is a bottom plan view of the article of footwear.
Figure 4:
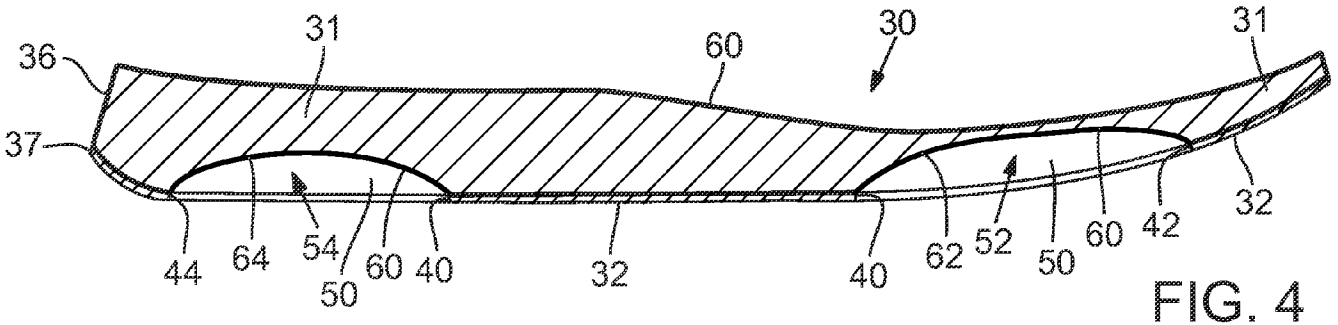
FIG. 4 is a cross-sectional view of the article of footwear, as defined by section line 4-4 in FIG. 3.
Figure 5:
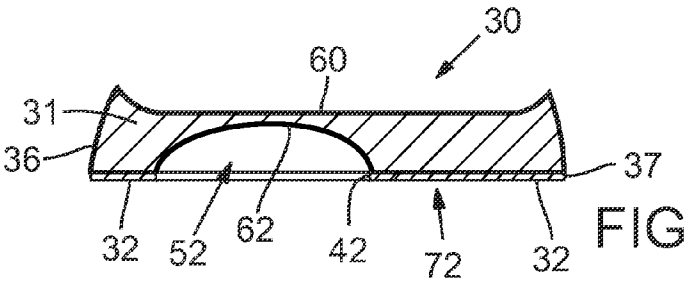
FIG. 5 is a cross-sectional view of the article of footwear, as defined by section line 5-5 in FIG. 3.
Figure 6:
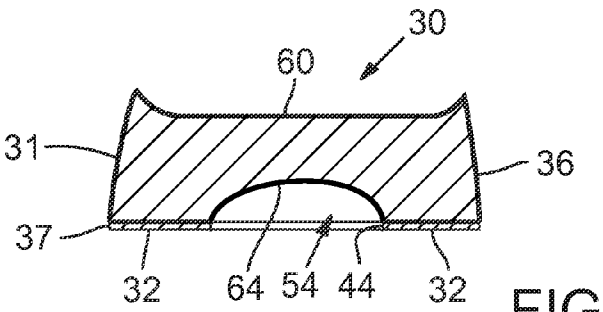
FIG. 6 is a cross-sectional view of the article of footwear, as defined by section line 6-6 in FIG. 3.

As previously noted, while hemispherical domes (i.e., domes having half-circle cross-sectional shape) provide physical strength and support, domes having shapes that are otherwise curved or arcuate may provide physical strength and support, too. For example, as depicted in FIG. 3, first recess 52 and first skin 62 in forefoot region 11 have an elongated shape, as do second recess 54 and second skin 64 in heel region 13.

More particularly, each of first recess 52 and second recess 54 has a longitudinal extent that exceeds its transverse extent. As depicted in FIGS. 3-6, a longitudinal extent, or length, of first recess 52 may be at least thirty percent of a longitudinal extent, or length, of sole structure 30. Similarly, a longitudinal extent (or length) of second recess 54 may be at least twenty percent of a longitudinal extent (or length) of sole structure 30.

In other configurations, however, recesses 52 and 54 may have comparable longitudinal extents and transverse extents. Recess 52 or recess 54 may have a hemispherical configuration, for example, in which the longitudinal and transverse extents are substantially the same.

Figure 7:
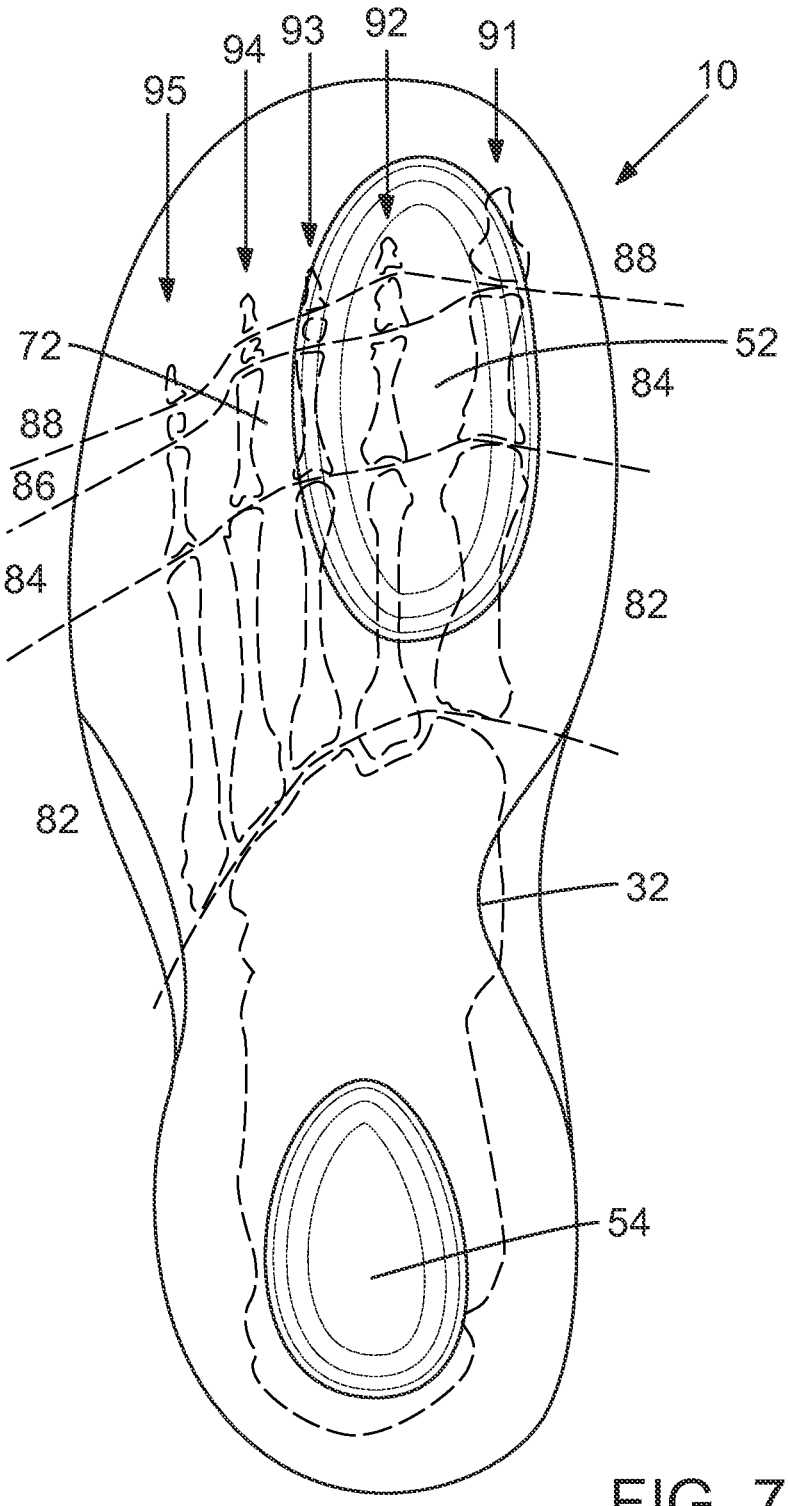
FIG. 7. is a bottom plan view of the article of footwear showing the position of an arcuate underside recess in relation to bones of a foot of a wearer.

Turning to FIG. 7, recesses 52 and 54 are depicted as extending across areas of footwear 10 associated with various bones of a foot of a wearer. As depicted, various areas of footwear 10 are associated with metatarsals 82, proximal phalanges 84, intermediate phalanges 86, and distal phalanges 88, and are also associated with the bones of first digit 91, second digit 92, third digit 93, fourth digit 94, and fifth digit 95. First recess 52 extends across an area of footwear 10 associated with at least half a length of metatarsals 82 of digits 91 and 92. First recess 52 also extends across an area of footwear 10 associated with at least half a length of the phalanges of digits 91 and 92, that is, at least half a total length of proximal phalanges 84, intermediate phalanges 86, and distal phalanges 88 of digits 91 and 92.

The elongate configurations of recesses 52 and 54, the positioning of first recess 52 toward one side of footwear 10, and the significant percentages of sole structure 30 spanned by recesses 52 and 54, may advantageously allow either first recess 52, second recess 54, or both to significantly impact the performance of footwear 10 under "banking" forces (such as forces due to pushing on footwear 10 in order to turn or "bank" to the left).

As a result of the positioning of first recess 52 and complementary region 72, forefoot region 11 of sole structure 30 has a non-uniform medio-lateral configuration in which medial side 15 includes exposed first recess 52, while lateral side 14 includes complementary region 72, and a thickness of midsole 31 in complementary region 72 is generally greater than a thickness of midsole 31 at first recess 52.

Figure 8:
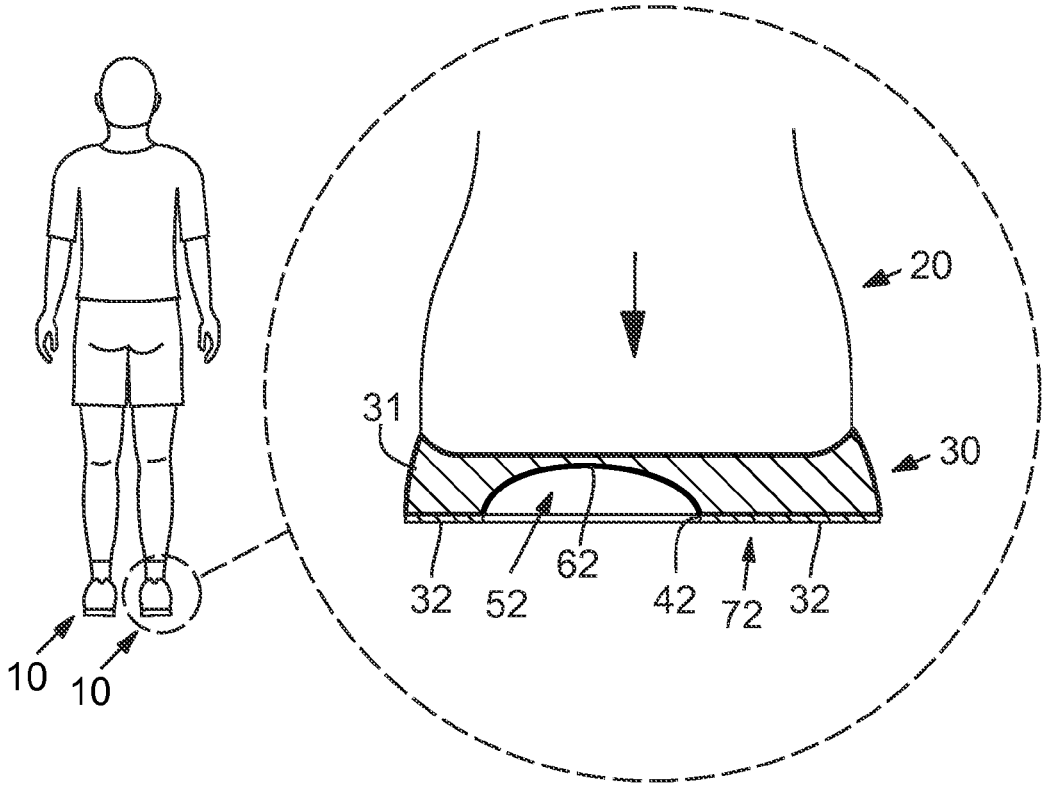
FIG. 8 is a cross-sectional view of the article of footwear of FIGS. 1-6 showing possible application of a vertical force.
Figure 9:
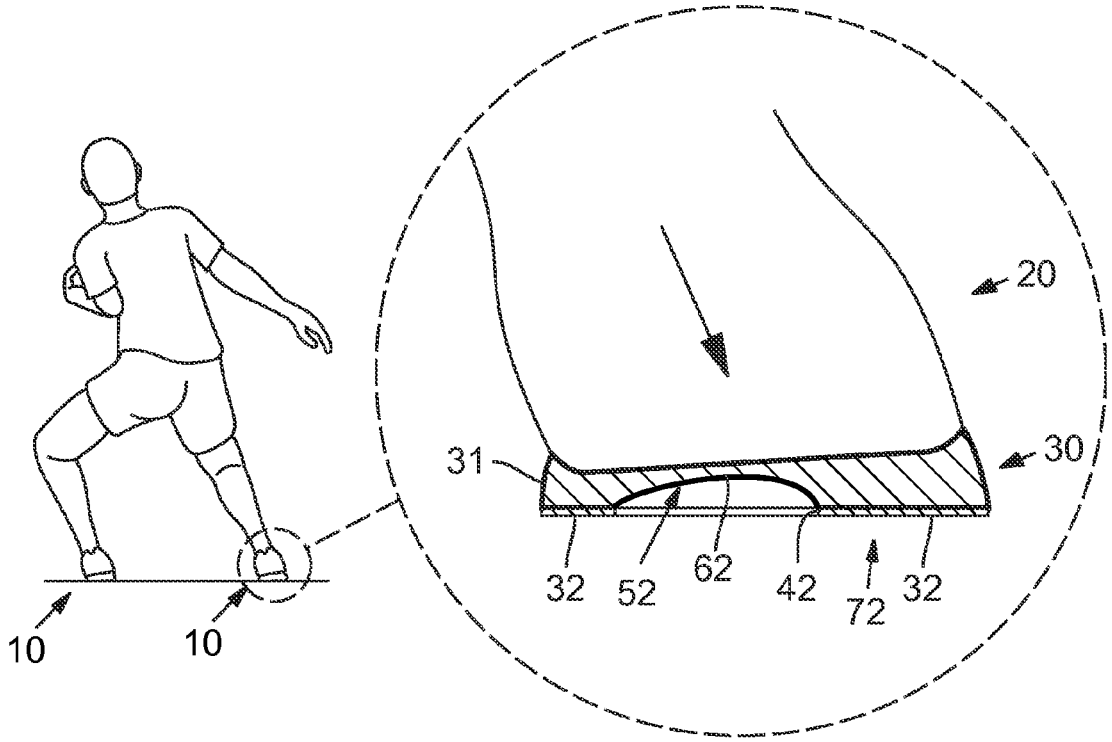
FIG. 9 is a cross-sectional view of the article of footwear of FIGS. 1-6 showing possible application of a lateral or banking force.

FIGS. 8-9 depict footwear 10 under various forces. Due to their physical properties, the domes of skins 62 and 64, as well as the domed polymer foam material adjacent to recesses 52 and 54, may provide support for vertical or downward forces upon midsole 31, such as forces associated with standing, walking, or running, as depicted in FIG. 8. As a result, skins 62 and 64 and recesses 52 and 54 may provide a degree of support comparable to complementary regions of midsole 31.

As depicted in FIGS. 8-9, for example, first recess 52 in forefoot region 11 is positioned on medial side 15 of footwear 10 (i.e., the "inside" of footwear 10), which is a left shoe. Meanwhile, complementary region 72 is positioned on lateral side 14 of footwear 10 (i.e., the "outside" of footwear 10, opposite first recess 52). Under a primarily downward or vertical force, skin 62 and recess 52 may provide upward support for the foot of the wearer comparable to the upward support provided by midsole 31 in complementary region 72.

At the same time, as depicted in FIG. 9, skin 62 and recess 52 may provide unique cushioning and support properties during banking, e.g., pushing off to the side from a medial or lateral side of the foot. A banking force may have both a downward or vertical component as well as a lateral or side-to-side component. When subjected to a banking force, skin 62 and recess 52 may provide a different degree of upward support for the foot of the wearer than the degree of upward support provided by the foamed polymer material of midsole 31 in complementary region 72. These different degrees of support may then facilitate the turning or banking movement, due to the non-uniform medio-lateral configuration sole structure 30 in forefoot region 11.

Incorporating recesses 50, skins 60, or both along one side of footwear 10 may thus allow the cushioning properties of footwear 10 to be optimized to respond to the sorts of forces applied to footwear 10 during side-to-side or lateral banking movements, while accommodating the sorts of vertical or downward forces applied to footwear 10 when standing, walking, or running.

Further Configurations

Figure 10:
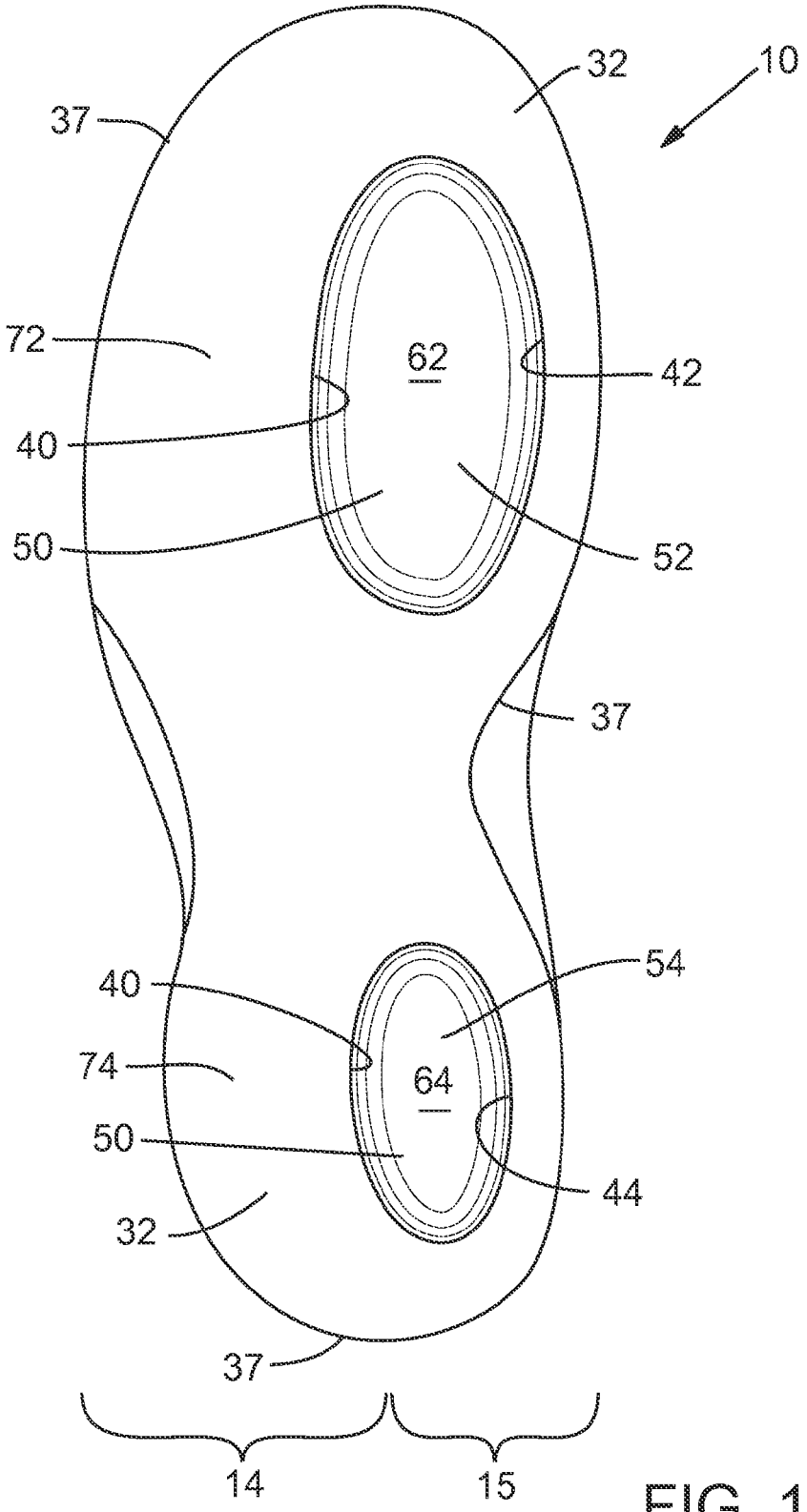
FIG. 10 is a bottom plan view corresponding with FIG. 3 and depicting a further configuration of the article of footwear.

FIGS. 3-6 depict second recess 54 as being positioned in a central part of heel region 13, i.e., as being comparably spaced from both lateral side 14 and medial side 15 of midsole periphery 36. In such configurations, second recess 54 may be separated from outer periphery 37 of outsole 32 by a portion of outsole 32 of generally uniform width. In other configurations, however, both first recess 52 and second recess 54 may be positioned on medial side 15 of footwear 10 (i.e., on the "inside" of footwear 10). As depicted in FIG. 10, for example, both first recess 52 and second recess 54 are positioned on medial side 15 of footwear 10, while complementary regions 72 and 74 are positioned on lateral side 14 opposite recesses 52 and 54, respectively.

Figure 11:
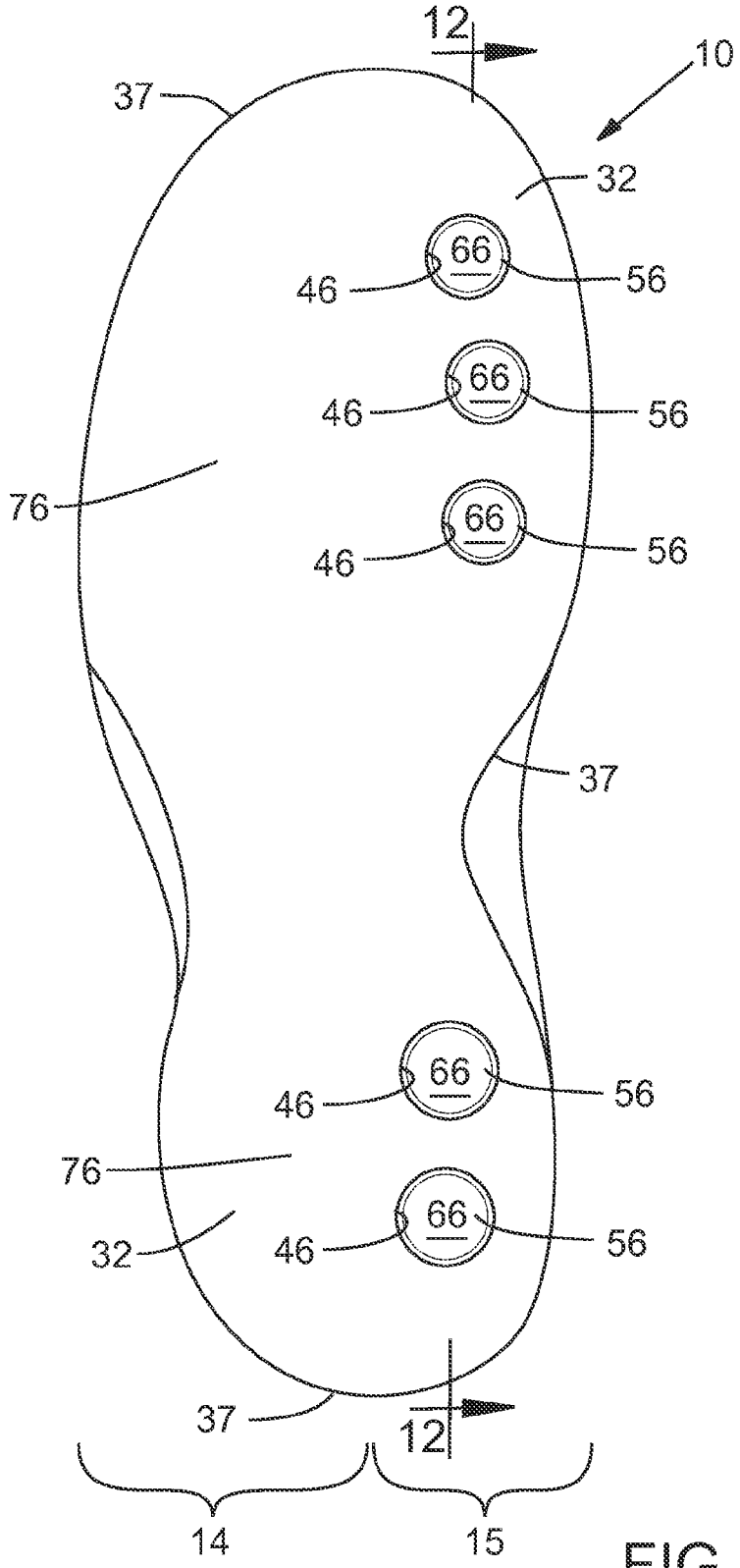
FIG. 11 is a bottom plan view corresponding with FIG. 3 and depicting a further configuration of the article of footwear.
Figure 12:
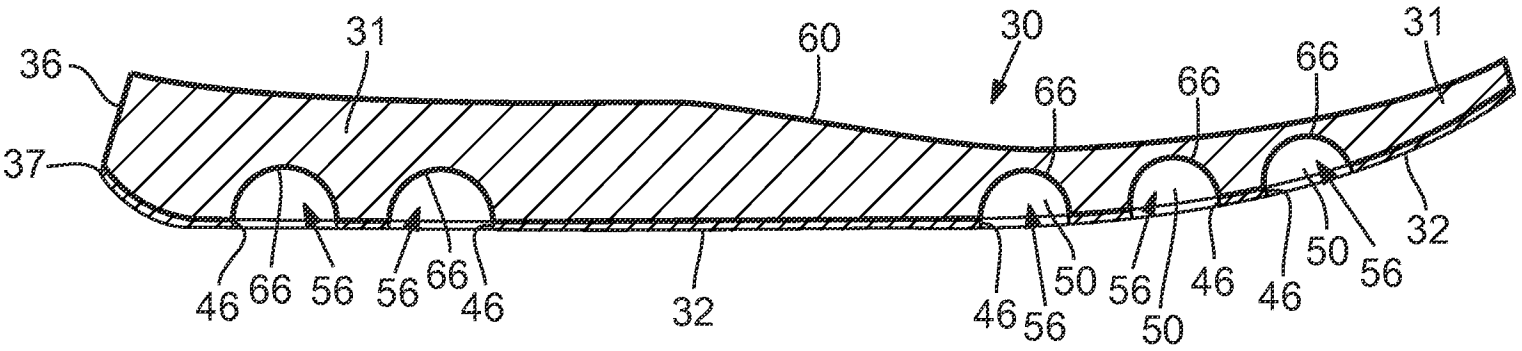
FIG. 12 is a cross-sectional view corresponding with FIG. 4, as defined by section line 12-12 in FIG. 11, depicting the article of footwear of FIG. 11.

In addition, although first recess 52 and second recess 54 are depicted in FIGS. 3-6 as having an elongate shape, alternate configurations of footwear 10 may include recesses 50 having hemispherical configurations. FIGS. 11-12 depict one exemplary configuration having recesses 56 positioned both in forefoot region 11 and heel region 13 on medial side 15, while complementary regions 76 are positioned opposite recesses 56 on lateral side 14 of footwear 10. Aligning recesses 56 to one side of footwear 10 allows the strength and cushioning benefits of dome-shaped skins 66 and recesses 56 to be optimized to respond to forces applied to footwear 10 during banking movements.

As shown in FIGS. 3-6, second recess 54 in heel region 13 has an elongate shape with a longitudinal extent that exceeds its transverse extent, and is dome-shaped or arcuate in cross-section. In addition, aperture 44 and second recess 54 have an arcuate shape as well, such as an oval or elliptical or egg-shaped configuration. In other configurations, however, the outer periphery of second recess 54 can have any of a variety of convex arcuate shapes.

Figure 14:
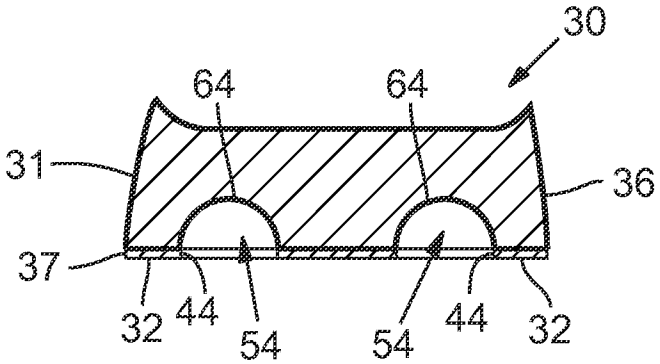
FIG. 14 is a cross-sectional view corresponding with FIG. 6, as defined by section line 14-14 in FIG. 13, depicting the article of footwear of FIG. 13.
Figure 13:
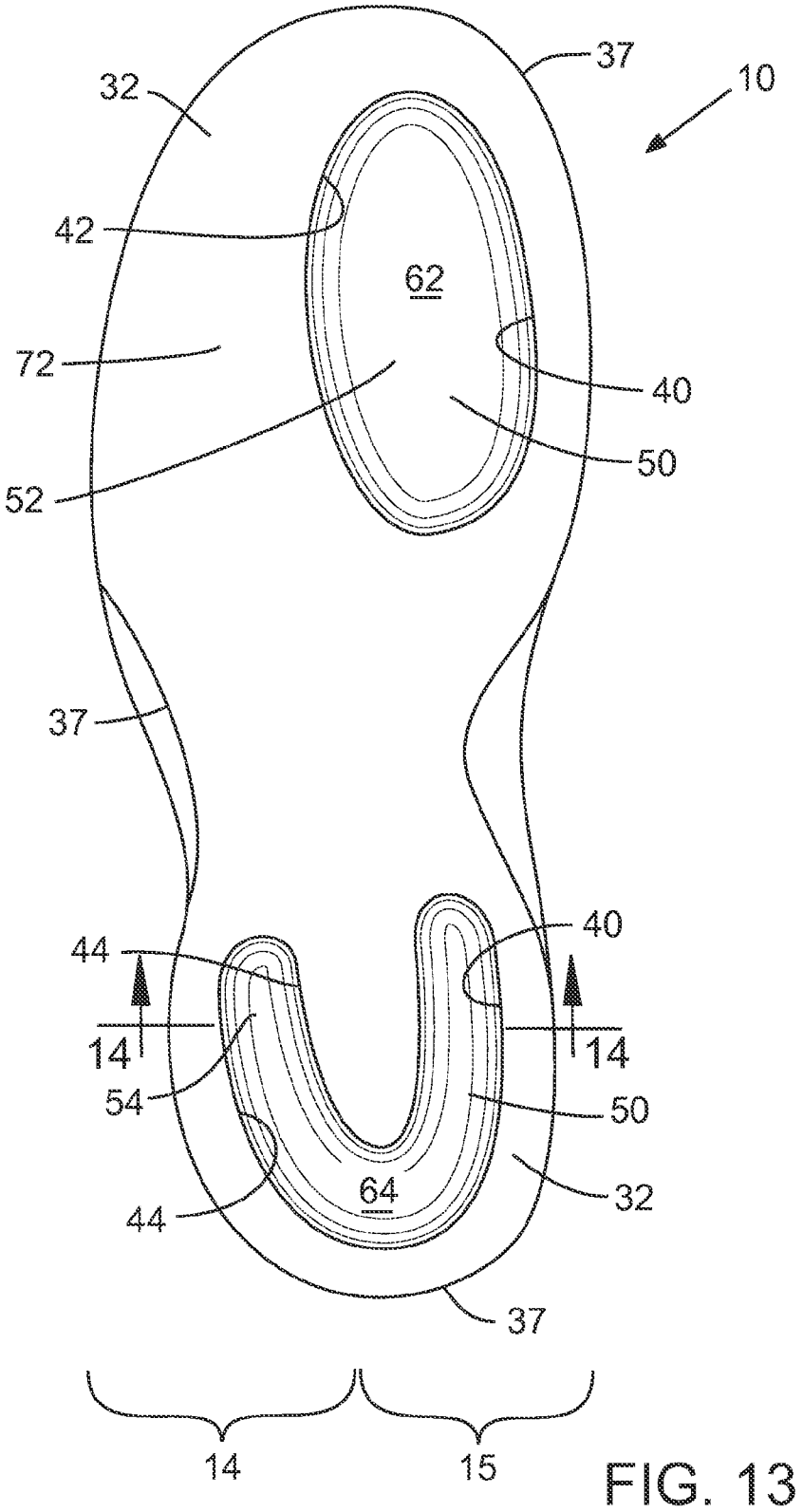
FIG. 13 is a bottom plan view corresponding with FIG. 3 and depicting a further configuration of the article of footwear.

In some configurations, the outer periphery of either first recess 52 or second recess 54 may have a non-convex shape. An exemplary configuration of footwear 10 in which second recess 54 has a non-convex shape is depicted in FIGS. 13-14. More particularly, second recess 54 of FIGS. 13-14 has a horseshoe shape or U-shape, including a lateral portion on lateral side 14, a medial portion on medial side 15, and a rear portion connecting the lateral portion and the medial portion at the rear of heel region 13.

As depicted in FIGS. 13-14, the lateral portion, the rear portion, and the medial portion of second recess 54 are contiguous, with the medial portion having a greater length than the lateral portion. However, in some configurations, the lateral portion, rear portion, and medial portion could be non-contiguous, distinct recesses in midsole 31.

Despite its U-shape when viewed from the bottom, second recess 54 has a circular or arcuate shape in cross-section. Due to the circular or arcuate shape of second recess 54 in cross-section, second skin 64 also has a circular or arcuate configuration in cross-section. These arcuate shapes allow skin 64 and recess 54 to form an elongated U-shaped dome on the underside of midsole 31. As a result, skin 64 and recess 54 may provide weight-supporting and load-bearing properties.

Figure 15:
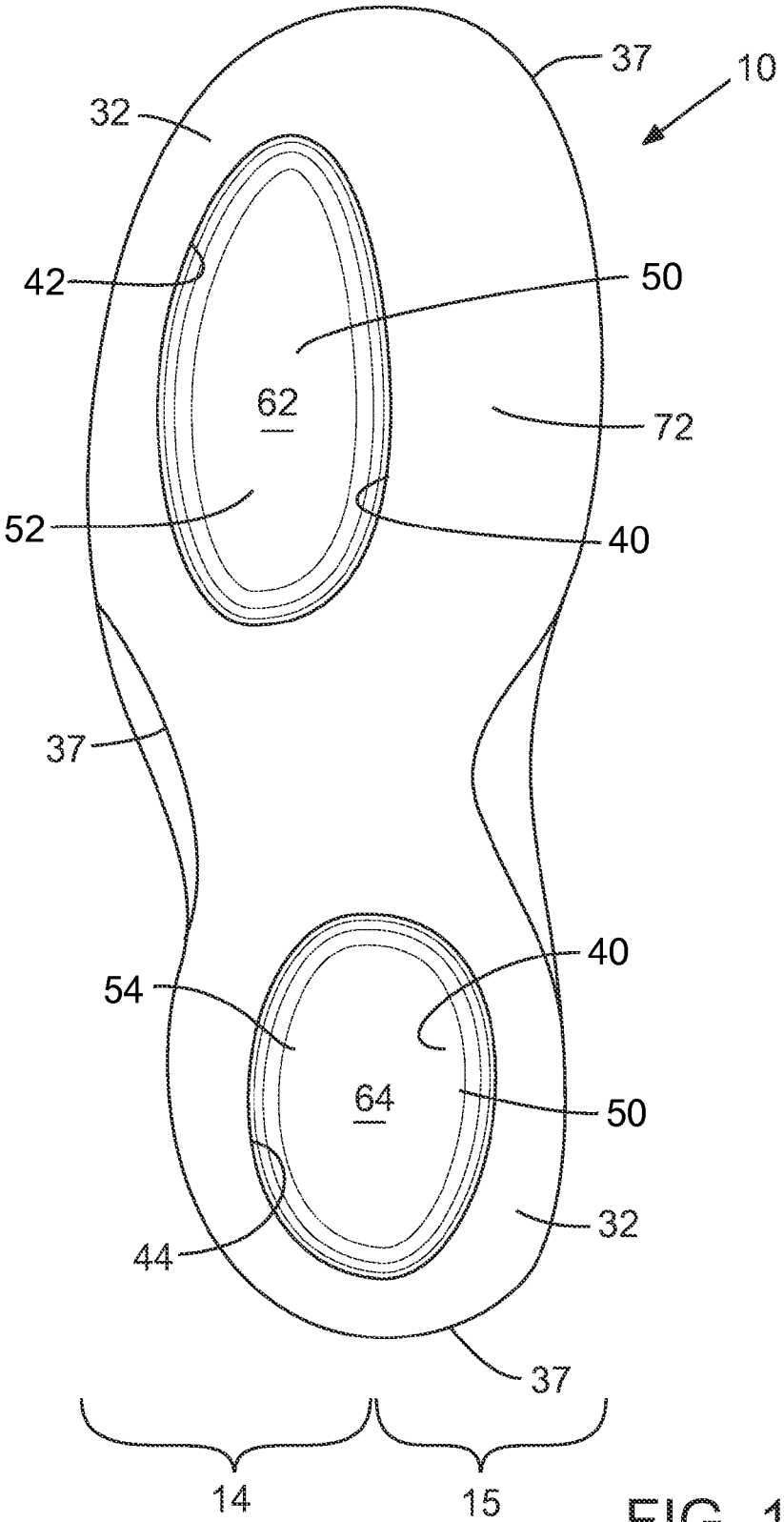
FIG. 15 is a bottom plan view corresponding with FIG. 3 and depicting a further configuration of the article of footwear.

FIGS. 3-6 depict first recess 52 as being on medial side 15 of footwear 10, but first recess 52 may be otherwise placed in other configurations. As depicted in FIG. 15, for example, first recess 52 is positioned on lateral side 14 of footwear 10, while complementary region 72 is positioned on medial side 15. Footwear 10 may, accordingly, have a recess 50 positioned on a first side, and a complementary region 72 in which midsole 31 is secured to both upper 20 and outsole 32 on a second side, and the first side can be either lateral side 14 or medial side 15.

Figure 16:
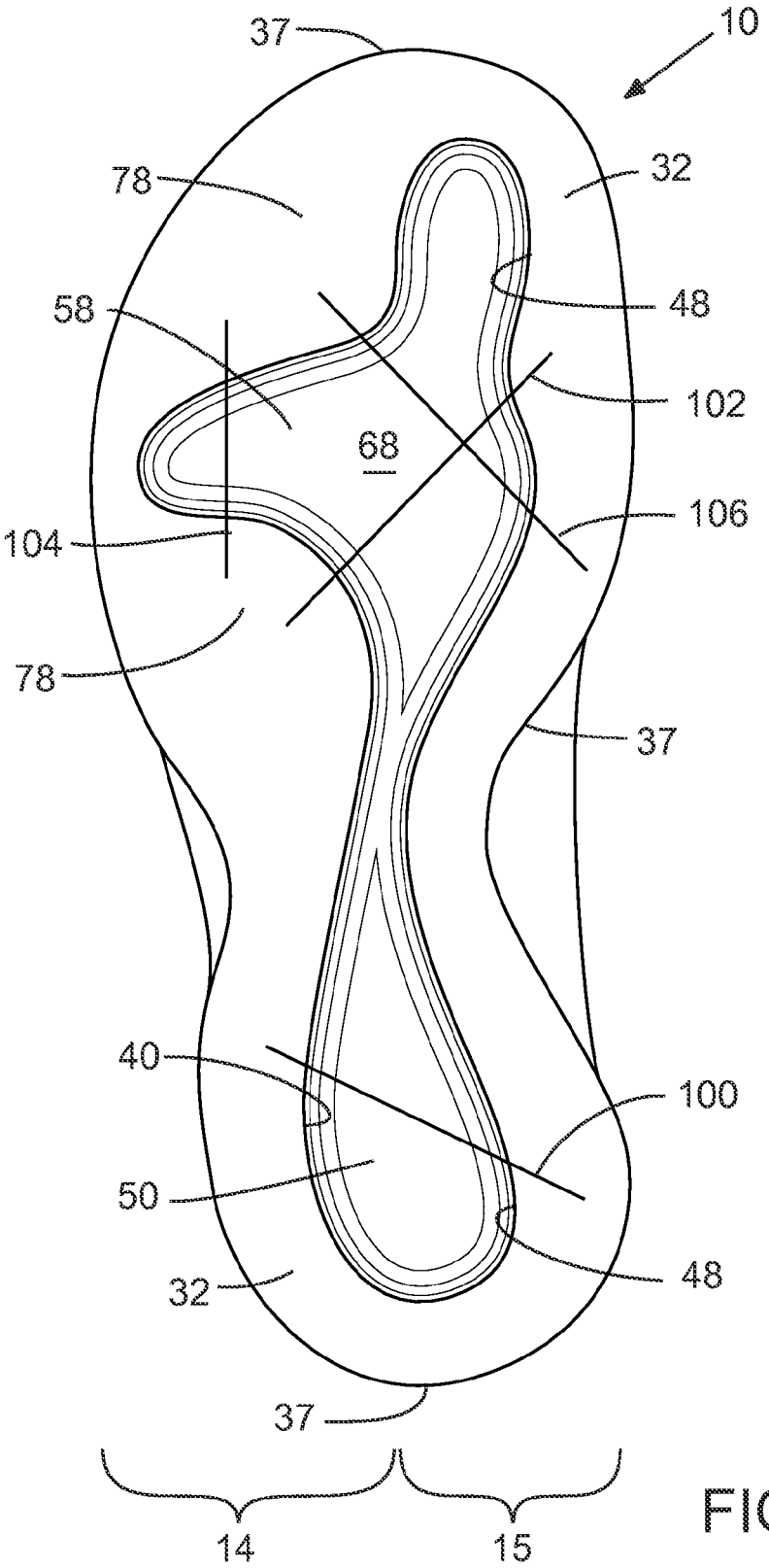
FIG. 16 is a bottom plan view corresponding with FIG. 3 and depicting a further configuration of the article of footwear.
Figure 17:
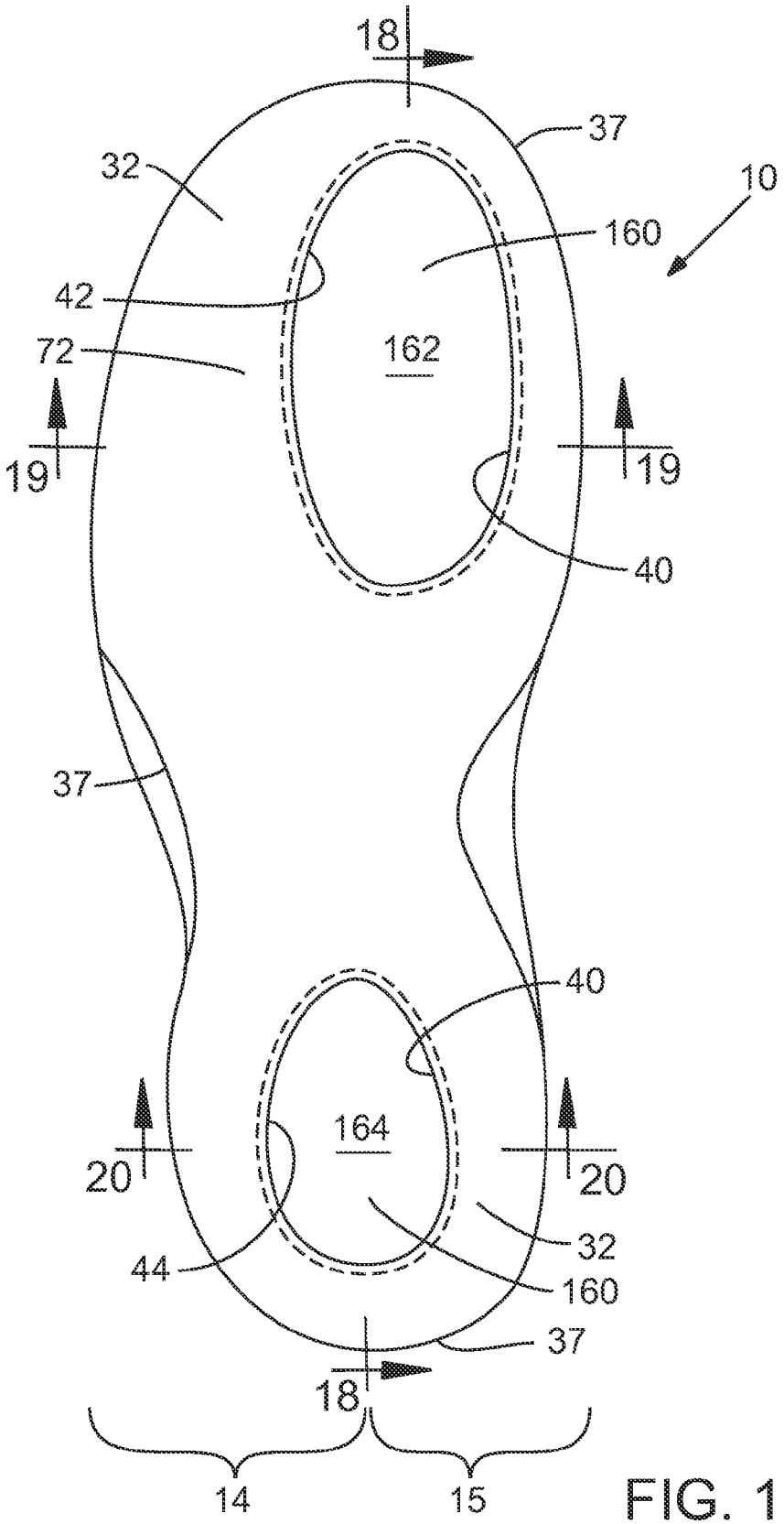
FIG. 17 is a bottom plan view depicting a further configuration of the article of footwear.
Figure 18:
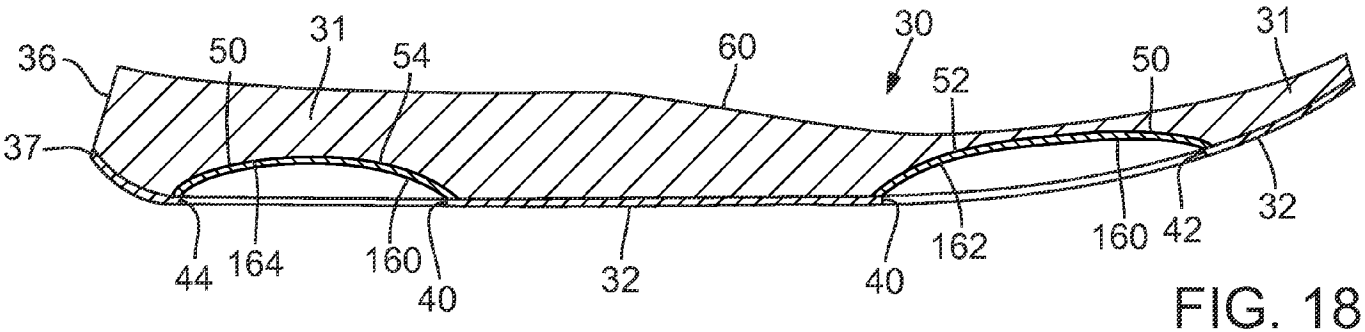
FIG. 18 is a cross-sectional view of the article of footwear of FIG. 17, as defined by section line 18-18 in FIG. 17.
Figure 19:
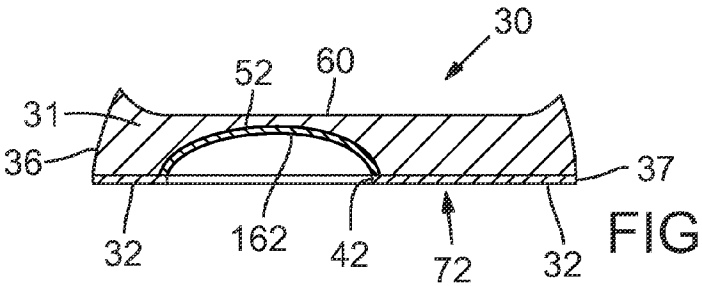
FIG. 19 is a cross-sectional view of the article of footwear of FIG. 17, as defined by section line 19-19 in FIG. 17.
Figure 20:
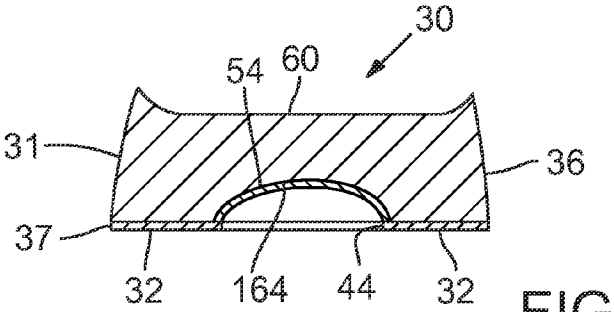
FIG. 20 is a cross-sectional view of the article of footwear of FIG. 17, as defined by section line 20-20 in FIG. 17.
Figure 21:
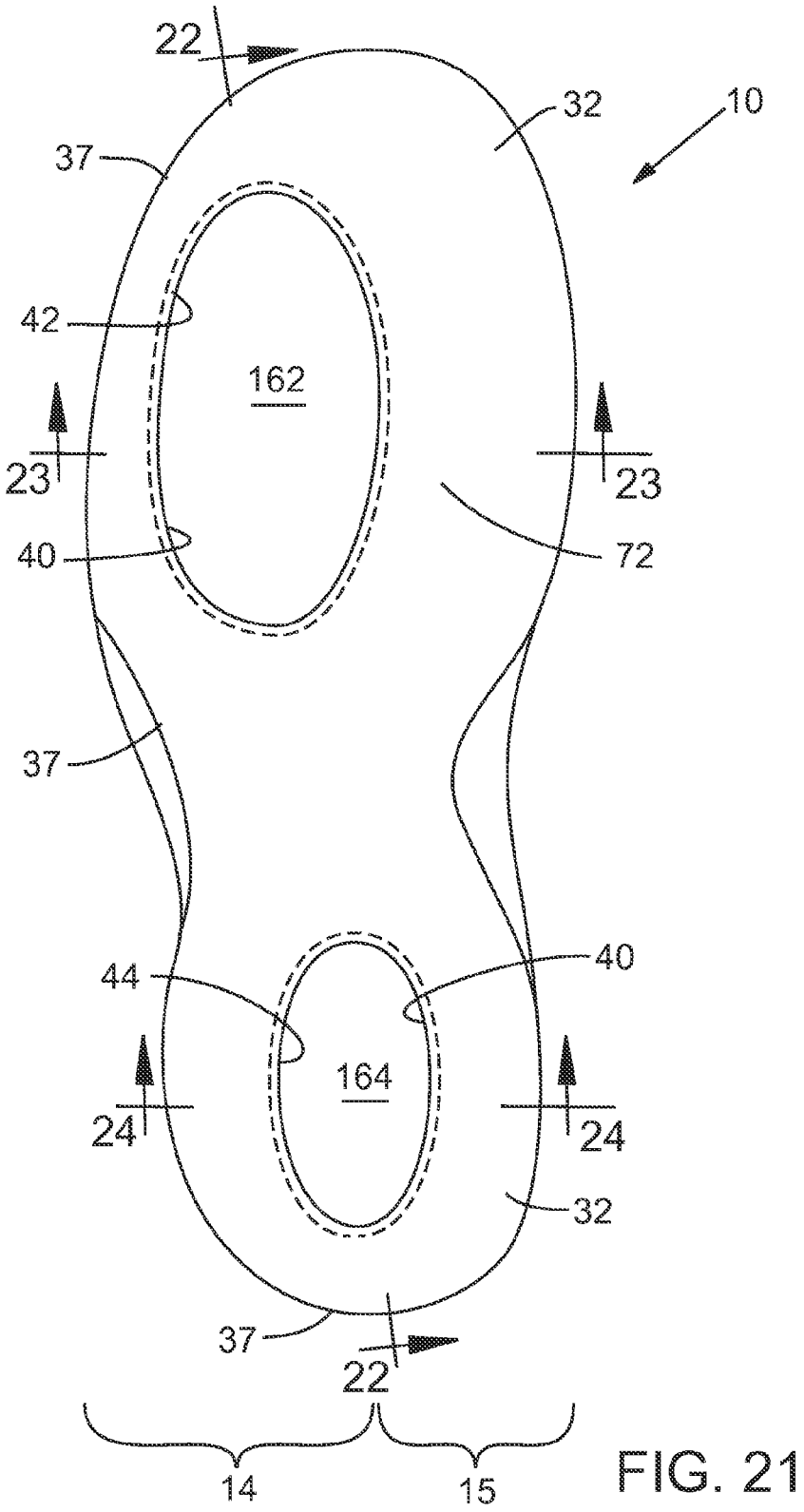
FIG. 21 is a bottom plan view depicting a further configuration of the article of footwear.
Figure 22:
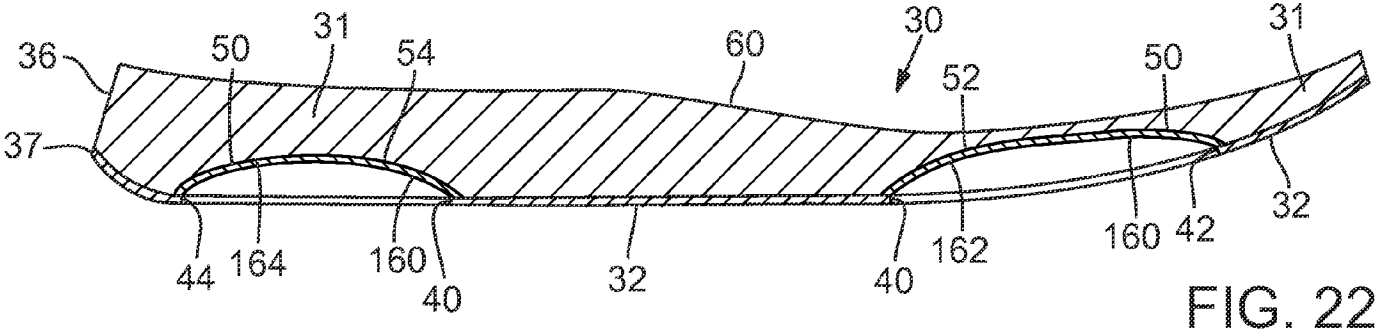
FIG. 22 is a cross-sectional view of the article of footwear of FIG. 17, as defined by section line 22-22 in FIG. 21.
Figure 23:
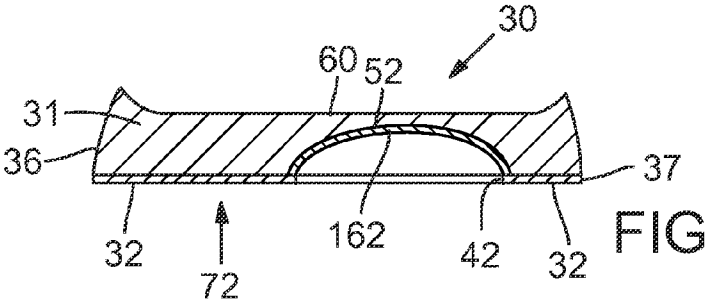
FIG. 23 is a cross-sectional view of the article of footwear of FIG. 17, as defined by section line 23-23 in FIG. 21.
Figure 24:
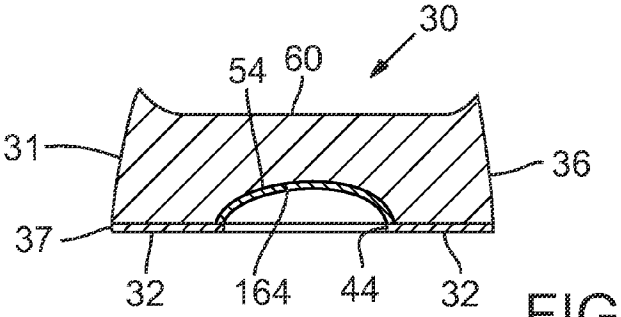
FIG. 24 is a cross-sectional view of the article of footwear of FIG. 17, as defined by section line 24-24 in FIG. 21.

Although recesses 51 and 52 of footwear 10 in FIGS. 3-6 are non-contiguous, distinct recesses, they may not be distinct in other articles of footwear. In the exemplary embodiment of FIG. 16, an elongated, asymmetrically shaped aperture 48 in outsole 32 exposes a corresponding elongated, asymmetrically shaped recess 58 extending into midsole 31. Recess 58 has a portion in forefoot region 11, a portion in midfoot region 12, and a portion in heel region 13. These portions are coupled and made contiguous. Recess 58 is primarily located on medial side 15, while complementary regions 78 are primarily located on lateral side 14. The portion of recess 58 in heel region 13 is separated from outer periphery 37 of outsole 32 by a portion of outsole 32 of generally uniform width. Skin 68 is, in turn, exposed through aperture 48.

Despite their asymmetric configuration, recess 58 and skin 68 may have semi-circular or arcuate shapes in cross-section. That is, for various planes 100, 102, 104 and 106, the associated cross-section will reveal an arcuate configuration in recess 58 and skin 68. This arcuate shape provides weight-supporting and load-bearing properties to recess 58 and skin 68.

Midsole Insert Element Configuration

The incorporation of other features into footwear 10 may allow its cushioning properties to be further optimized to respond to forces applied during side-to-side or lateral banking movements, while accommodating vertical or downward forces. Turning to FIGS. 17-20, midsole 31 is depicted as having inwardly-extending arcuate recesses 50, and correspondingly arcuate insert elements 160 extending into recesses 50. Insert elements 160 are plates whose arcuate cross-sectional configurations provide structural support to sole structure 30 and footwear 10.

Each insert element 160 is secured to a recess 50. That is, each insert element 160 has an upper surface secured to the lower surface of midsole 31 within an arcuate recess 50. More particularly, midsole 31 has a first arcuate insert element 162 secured to midsole 31 within first recess 52 in forefoot region 11, and a second arcuate insert element 164 secured to midsole 31 within second recess 54 in heel region 13. Accordingly, as depicted, first insert element 162 is a forefoot insert element, and second insert element 164 is a heel insert element.

Meanwhile, first aperture 42 and second aperture 44 extending through outsole 32 are formed to expose recesses 52 and 54, and to cover peripheral edges of insert elements 162 and 164 secured to recesses 52 and 54. That is, apertures 42 and 44 are smaller than the peripheral edges of insert elements 162 and 164.

Lower surfaces of insert elements 160 are exposed to an exterior of footwear 10 through apertures 40. Specifically, first insert element 162 is exposed through first aperture 42, while second insert element 164 is exposed through second aperture 44. Meanwhile, outsole 31 is secured to midsole 31 in bonded areas that wholly surround apertures 42 and 44, recesses 52 and 54, and insert elements 162 and 164.

Although FIGS. 17-20 depict apertures 40 as exposing various insert elements 160 within recesses in midsole 31, in various alternate configurations, outsole 32 may instead extend partially or entirely across one or more insert elements 160. In some such configurations, insert elements 160 may be interior portions of sole structure 30 spaced from the upper surface of outsole 32. In other configurations, outsole 32 may conform to both the lower surface of midsole 31 and the lower surface of one or more insert elements 160, and portions of outsole 32 may thereby have arcuate shapes corresponding to the arcuate shapes of insert elements 160 and recesses 50.

Since insert elements 160 conform to recesses 50, insert elements 160 have shapes corresponding to the shapes of recesses 50. For example, first insert element 162 has the arcuate shape of first recess 52, and second insert element 164 has the arcuate shape of second recess 154. Due to their arcuate cross-sectional shapes, insert elements 162 and 164 form domes on an underside of midsole 31. That is, insert elements 162 and 164 form arcuate, curved structures whose physical properties may provide weight-supporting benefits to midsole 31. Although there is less foamed polymer material above arcuate recesses 52 and 54 than above other areas of midsole 31, insert elements 62 and 64 may provide support to compensate for the foamed polymer material absent from recesses 52 and 54.

Insert elements 160 are arcuate plates, i.e., layers of uniformly thick material, and are applied to, bonded to, or otherwise secured to midsole 31. Insert elements 160 can include materials that are different from both the sorts of foamed polymer materials that may be used for midsole 31 and the sorts of rubber materials that may be used for outsole 32. For example, insert elements 160 may include a polyester material such as a thermoplastic polyurethane (TPU). In some embodiments, a sheet of TPU may be thermoformed and thermobonded to midsole 31 within recesses 50. The different materials used to form insert elements 160 can allow insert elements 160 to provide properties different from those of foamed polymer materials and rubber materials, including different hardness and pliability properties, and different properties related to appearance (such as by use of a translucent or transparent TPU material).

In other configurations, however, insert elements 160 may be formed from a different foamed polymer material than the foamed polymer material of midsole 31. For example, insert elements 160 may be formed from a polymer foam material having a higher density than a polymer foam material of midsole 31. Similarly, insert elements 160 may be formed of a different rubber material than the rubber material of outsole 32, such as a rubber material having a greater hardness than a rubber material of outsole 32.

Other materials that may also be used for insert elements 160 include: an injection-molding-grade thermoplastic or thermoset polymer material; a composite material, such as a fiber-reinforced polymer material, or carbon fiber material; an engineered textile with a fused adhesive skin; or a multi-material laminate structure. The material and thickness of insert elements 160 may accordingly allow the support and cushioning of sole structure 30 to be optimized for a particular activity, or type of athlete.

As depicted, insert elements 162 and 164 extend upward into midsole 31 to a comparable degree. However, as discussed above regarding FIGS. 3-6, the heights of recesses 52 and 54 may vary. That is, recesses 52 and 54 may extend upward into midsole 31 to varying degrees. Since insert elements 162 and 164 conform to recesses 52 and 54, respectively, insert elements 162 and 164 may extend upward into midsole 31 to different degrees than depicted in FIGS. 17-20.

Insert elements 162 and 164 also have elongated configurations, to conform to the elongated shapes of recesses 52 and 54. First insert element 162 may be at least thirty percent of a longitudinal extent, or length, of sole structure 30, while second insert element 164 may be at least twenty percent of a longitudinal extent, or length, of sole structure 30. Although elongate, insert elements 162 and 164 have an arcuate or curved cross-sectional configuration that may provide physical strength and support.

As discussed above regarding FIGS. 3-6, however, recesses 52 and 54 in some configurations may have comparable longitudinal extents and transverse extents, such as when recesses 52 and 54 are hemispherical. In such configurations, insert elements 62 and 64 may have correspondingly hemispherical configurations, with comparable longitudinal and transverse extents.

Although FIGS. 17-20 depict first recess 52 and first insert element 162 as being positioned on medial side 15 of forefoot region 11, in other configurations, first recess 52 and first insert element 162 may be otherwise positioned. For example, as depicted in FIGS. 21-24, first recess 162 and first insert element 164 are positioned on lateral side 14 of footwear 10, while complementary region 72 is positioned on medial side 15.

The elongate configurations of insert elements 162 and 164, the positioning of insert element 162 toward one side of footwear 10, and the significant percentage of sole structure 30 spanned by insert elements 160 may advantageously allow either insert element 162, insert element 164, or both to significantly impact the performance of footwear 10 under banking forces.

As depicted in FIGS. 21-24, the positioning of first insert element and complementary region 72 give sole structure 30 a non-uniform medio-lateral configuration in which medial side 15 includes complementary region 72, while lateral side 14 includes first insert element 162, and a thickness of midsole 31 in complementary region 72 is generally greater than a thickness of midsole 31 above first insert element 162.

Figure 25:
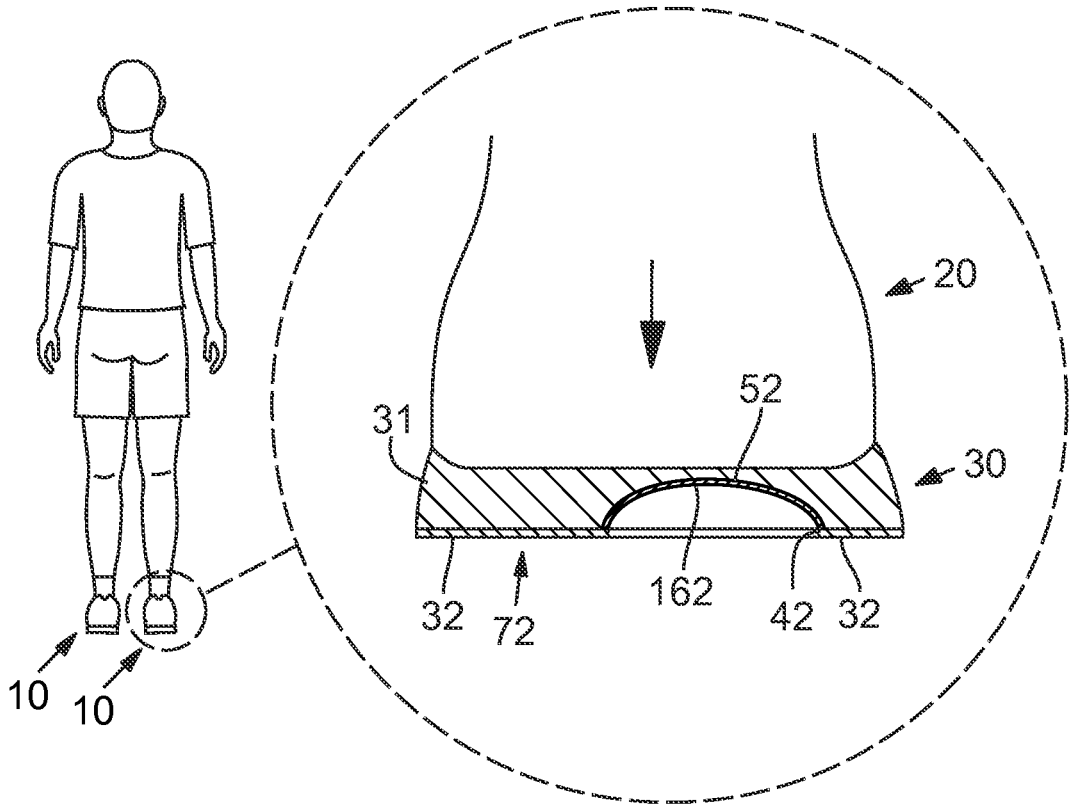
FIG. 25 is a cross-sectional view of the article of footwear of FIGS. 21-24 showing possible application of a vertical force.
Figure 26:
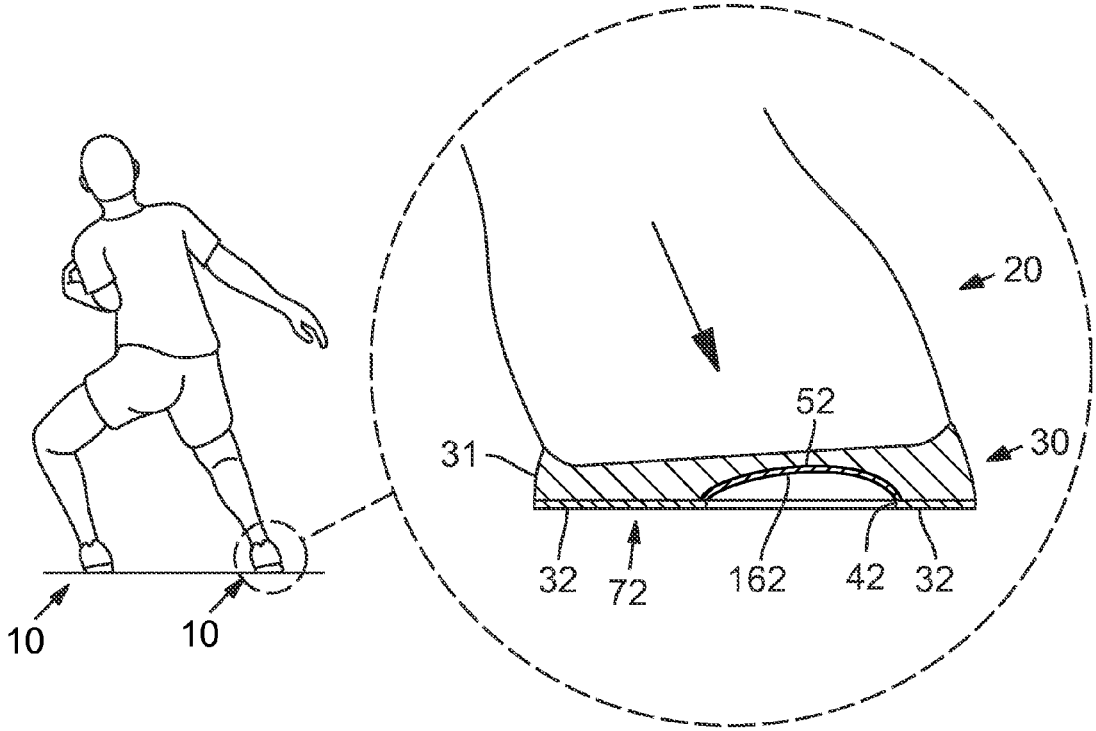
FIG. 26 is a cross-sectional view of the article of footwear of FIGS. 21-24 showing possible application of a lateral or banking force.
Figure 27:
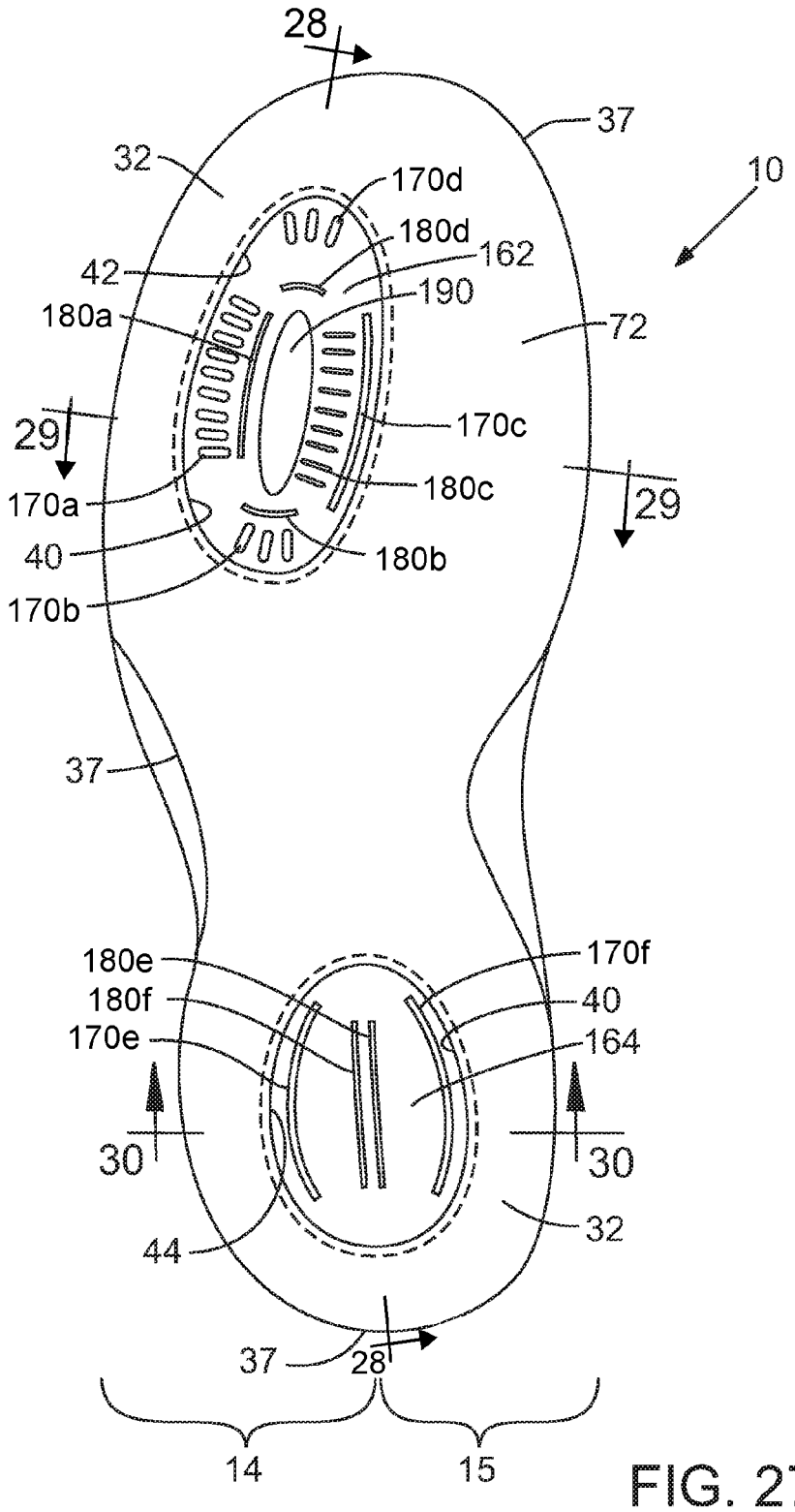
FIG. 27 is a bottom plan view depicting a further configuration of the article of footwear.
Figure 28:
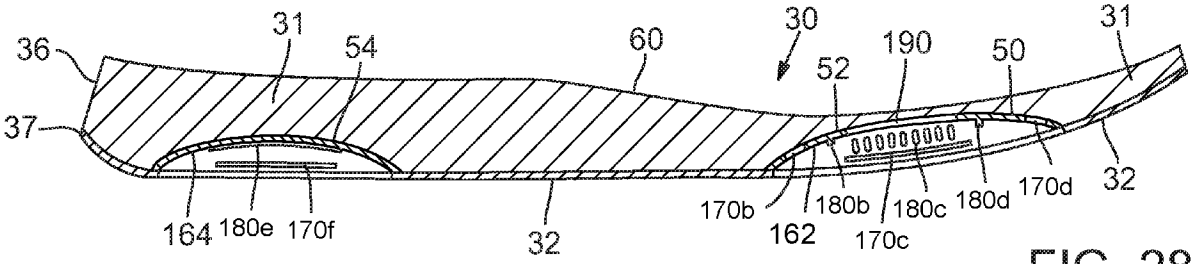
FIG. 28 is a cross-sectional view of the article of footwear of FIG. 17, as defined by section line 28-28 in FIG. 27.
Figure 29:
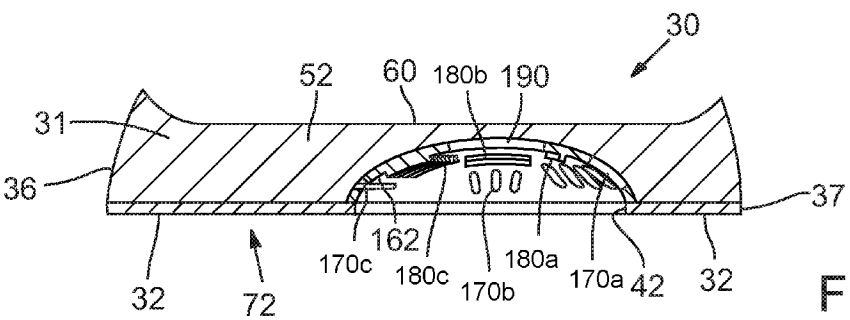
FIG. 29 is a cross-sectional view of the article of footwear of FIG. 17, as defined by section line 29-29 in FIG. 27.
Figure 30:
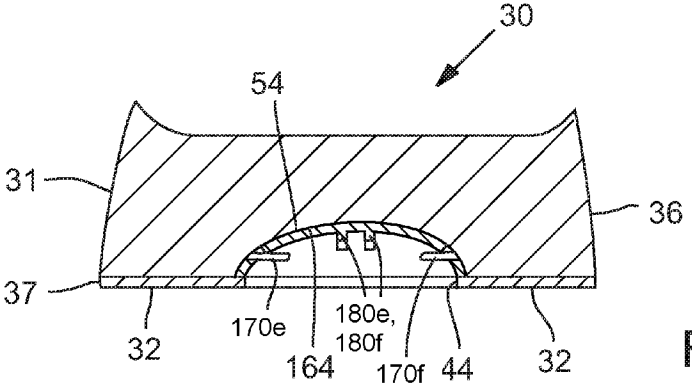
FIG. 30 is a cross-sectional view of the article of footwear of FIG. 17, as defined by section line 30-30 in FIG. 27.

FIGS. 25-26 depict the footwear of FIGS. 21-24 under various forces. Due to their physical properties, insert elements 162 and 164, as well as the domed polymer foam material adjacent to them, may provide support for vertical or downward forces upon midsole 31, such as forces associated with standing, walking, or running, as depicted in FIG. 25. Insert elements 162 and 164 may accordingly provide a degree of support greater than or equal to the degree of support provided by complementary region 72 of midsole 31.

As depicted in FIGS. 25-26, insert element 162 in forefoot region 11 is positioned on lateral side 14 of footwear 10, while complementary region 72 is positioned on medial side 15. Under a primarily downward or vertical force, insert element 162 (and recess 52) may provide upward support for the foot of the wearer greater than or equal to the upward support provided by midsole 31 in complementary region 72.

In comparison, as depicted in FIG. 26, insert element 162 and recess 52 may provide cushioning and support properties during banking, which may have both a downward or vertical component and a lateral or side-to-side component. When subjected to a banking force, insert element 162 and recess 52 may provide a different degree of upward support for the foot of the wearer than the degree of upward support provided by the foamed polymer material of midsole 31 in complementary region 72. These different degrees of support may then facilitate the turning or banking movement, due to the non-uniform medio-lateral configuration of sole structure 30 in forefoot region 11.

Thus, incorporating recesses 50 and insert elements 160 along one side of footwear 10 may allow the cushioning properties of footwear 10 to be optimized to respond to the sorts of forces applied during side-to-side or lateral banking movements, while accommodating the sorts of vertical or downward forces applied to footwear 10 when standing, walking, or running.

Although insert elements 160 are depicted in FIGS. 21-24 as being layers of uniformly thick material, insert elements 160 may incorporate other features. Turning to FIGS. 27-30, insert elements 162 and 164 are depicted as incorporating slots 170*a*, 170*b*, 170*c*, 170*d*, 170*e*, or 170*f* and ridges 180*a*, 180*b*, 180*c*, 180*d*, 180*e*, or 180*f*. Slots 170*a*, 170*b*, 170*c*, 170*d*, 170*e*, or 170*f* extend through insert elements 160 and between the upper and lower surfaces of insert elements 160. Accordingly, slots 170*a*, 170*b*, 170*c*, 170*d*, 170*e*, or 170*f* are openings in insert elements 160 that expose portions of the midsole at recesses 50. Some slots 170 extend in a substantially medio-lateral direction (i.e., a direction extending between lateral side 14 and medial side 15), while other slots 170*a*, 170*b*, 170*c*, 170*d*, 170*e*, or 170*f* extend in a substantially fore-aft direction (i.e., a direction extending between forefoot region 11 and heel region 13). In addition, some slots 170*a*, 170*b*, 170*c*, 170*d*, 170*e*, or 170*f* comprise a neighboring plurality of slots, which are positioned adjacent to each other and extend in substantially the same direction.

While slots 170*a*, 170*b*, 170*c*, 170*d*, 170*e*, or 170*f* are depicted in FIGS. 27-30 as extending through insert elements 160, in some configurations, they may extend only partially through insert elements 160. For example, slots may be grooves or indentations defined on the lower surfaces of insert elements 160, and may extend upward and inward into insert elements 160.

Ridges 180*a*, 180*b*, 180*c*, 180*d*, 180*e*, or 180*f* are protrusions defined on the lower surfaces of insert elements 160. That is, ridges 180*a*, 180*b*, 180*c*, 180*d*, 180*e*, or 180*f* extend downward and outward from insert elements 160. Accordingly, insert elements 160 have a greater thickness at ridges 180*a*, 180*b*, 180*c*, 180*d*, 180*e*, or 180*f* than outside of ridges 180*a*, 180*b*, 180*c*, 180*d*, 180*e*, or 180*f*. As with slots 170*a*, 170*b*, 170*c*, 170*d*, 170*e*, or 170*f*, some ridges 180*a*, 180*b*, 180*c*, 180*d*, 180*e*, or 180*f* extend in a substantially medio-lateral direction, while other ridges 180*a*, 180*b*, 180*c*, 180*d*, 180*e*, or 180*f* extend in a substantially fore-aft direction. Similarly, some ridges 180*a*, 180*b*, 180*c*, 180*d*, 180*e*, or 180*f* comprise a neighboring plurality of slots, which are positioned adjacent to each other and extend in substantially the same direction.

Slots 170*a*, 170*b*, 170*c*, 170*d*, 170*e*, or 170*f* may allow some regions of insert elements 160 to be more prone to deformation under forces applied in certain directions. Slots 170*a*, 170*b*, 170*c*, 170*d*, 170*e*, or 170*f* may thereby allow for selective deflection, or controlled collapsing, of those regions of insert elements 160. In contrast, ridges 180*a*, 180*b*, 180*c*, 180*d*, 180*e*, or 180*f* may allow other regions of insert elements 160 to be less prone to deformation when subjected to forces in certain directions, and may thereby allow for selective deflection or controlled collapsing outside those other regions of insert elements 160.

As with slots 170*a*, 170*b*, 170*c*, 170*d*, 170*e*, or 170*f*, a central opening 190 through the center of first element 162 may allow for selective deformation of first element 162. With central opening 190, first insert element 162 may compressively deform when subjected to a downward force, while storing energy to return to its previous shape upon removal of the downward force. Accordingly, central opening 190 may impart spring-like properties to first element 162.

With the inclusion of slots 170*a*, 170*b*, 170*c*, 170*d*, 170*e*, or 170*f*, ridges 180*a*, 180*b*, 180*c*, 180*d*, 180*e*, or 180*f*, and central opening 190, various physical properties of insert elements 160, such as pliability and flexibility, may be optimized or tuned. Various configurations of slots 170*a*, 170*b*, 170*c*, 170*d*, 170*e*, or 170*f*, ridges 180*a*, 180*b*, 180*c*, 180*d*, 180*e*, or 180*f*, and central opening 190 may therefore alter the direction, degree, and type of support and cushioning provided by insert elements 160 to sole structure 30.

Further Insert Element Configurations

Figure 31:
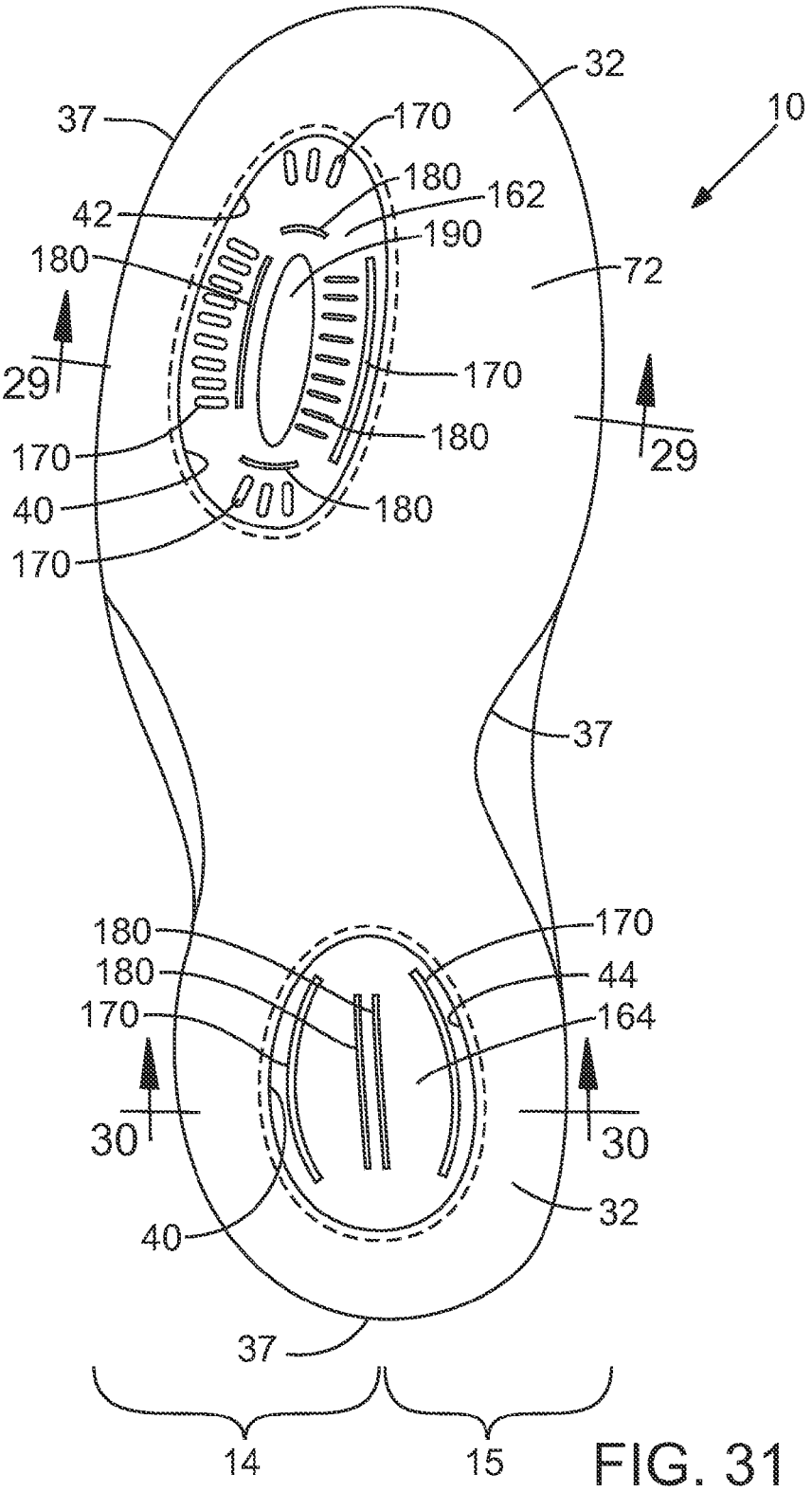
FIG. 31 is a bottom plan view corresponding with FIG. 27 and depicting a further configuration of the article of footwear.

Second recess 54 and second insert element 164 are depicted in FIGS. 27-30 as being positioned in a central part of heel region 13. In other words, second insert element 164 is similarly spaced from both lateral side 14 and medial side 15 of outer periphery 36 of midsole 31, and is separated from outer periphery 37 outsole 32 by a portion of outsole 32 of generally uniform width. However, in other configurations, second recess 54 and second insert element 164 may be positioned on lateral side 14 of footwear 10 (i.e., on the "outside" of footwear 10). As depicted in FIG. 31, for example, both first insert element 162 and second insert element 164 are positioned on lateral side 14 of footwear 10, while complementary regions 72 and 74 are positioned on medial side 15 opposite insert elements 162 and 164, respectively.

Figure 32:
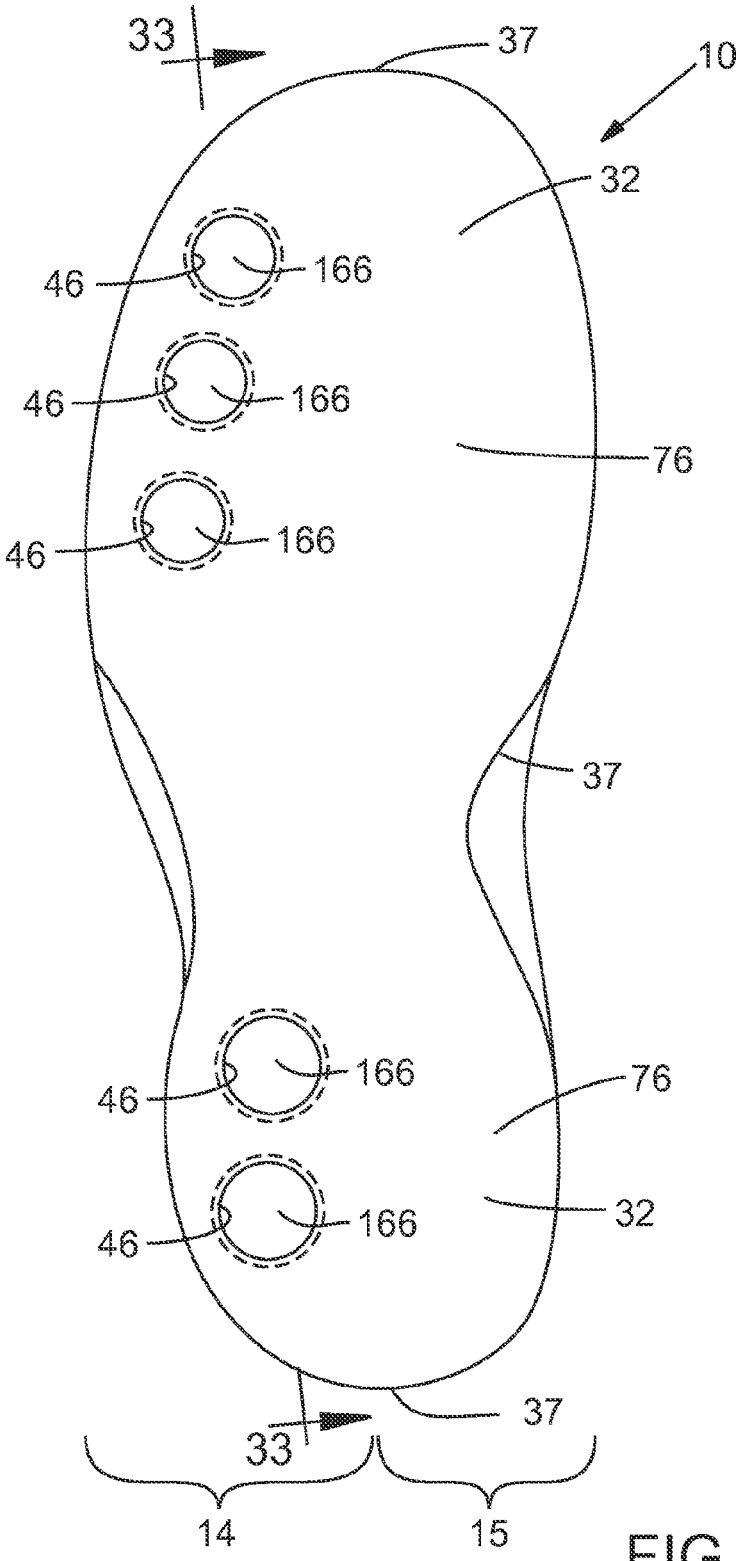
FIG. 32 is a bottom plan view corresponding with FIG. 27 and depicting a further configuration of the article of footwear.
Figure 33:
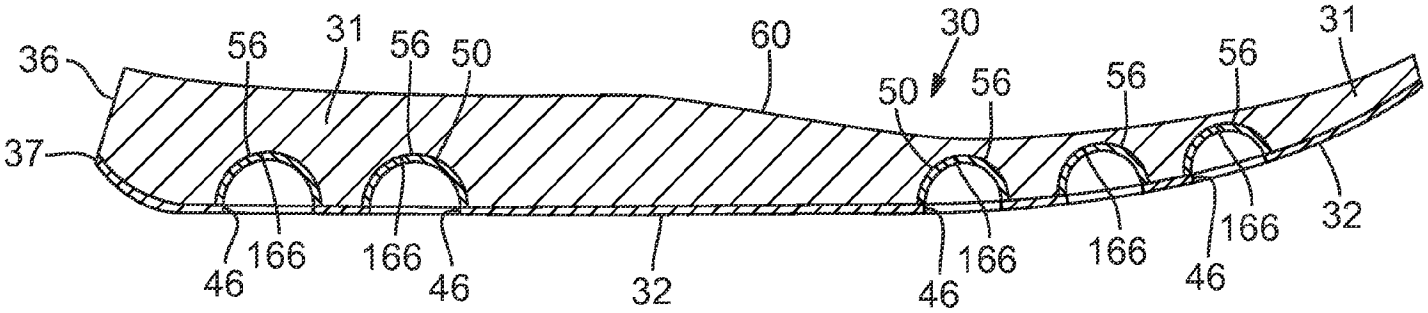
FIG. 33 is a cross-sectional view corresponding with FIG. 28, as defined by section line 33-33 in FIG. 32, depicting the article of footwear of FIG. 32.

Although insert elements 160 are depicted in FIGS. 27-30 as having elongate shapes with dome-shaped or arcuate cross-sections, which may provide strength and support to sole structure 30, insert elements 160 may be otherwise shaped. FIGS. 32-33, for example, depict an exemplary configuration of footwear 10 incorporating hemispherical insert elements 166 (within recesses 56) positioned both in forefoot region 11 and heel region 13 on lateral side 14, with complementary regions 76 positioned opposite hemispherical insert elements 166 on medial side 15 of footwear 10. In other configurations, the outer peripheries of insert elements 162 and 164 may have any of a variety of convex shapes, such as an oval or elliptical or egg shape.

Figure 35:
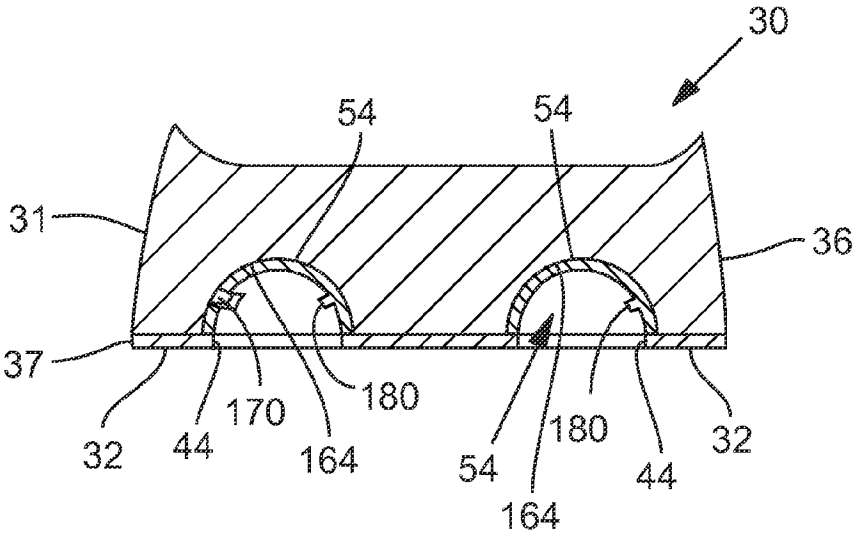
FIG. 35 is a cross-sectional view corresponding with FIG. 30, as defined by section line 35-35 in FIG. 34, depicting the article of footwear of FIG. 34.
Figure 34:
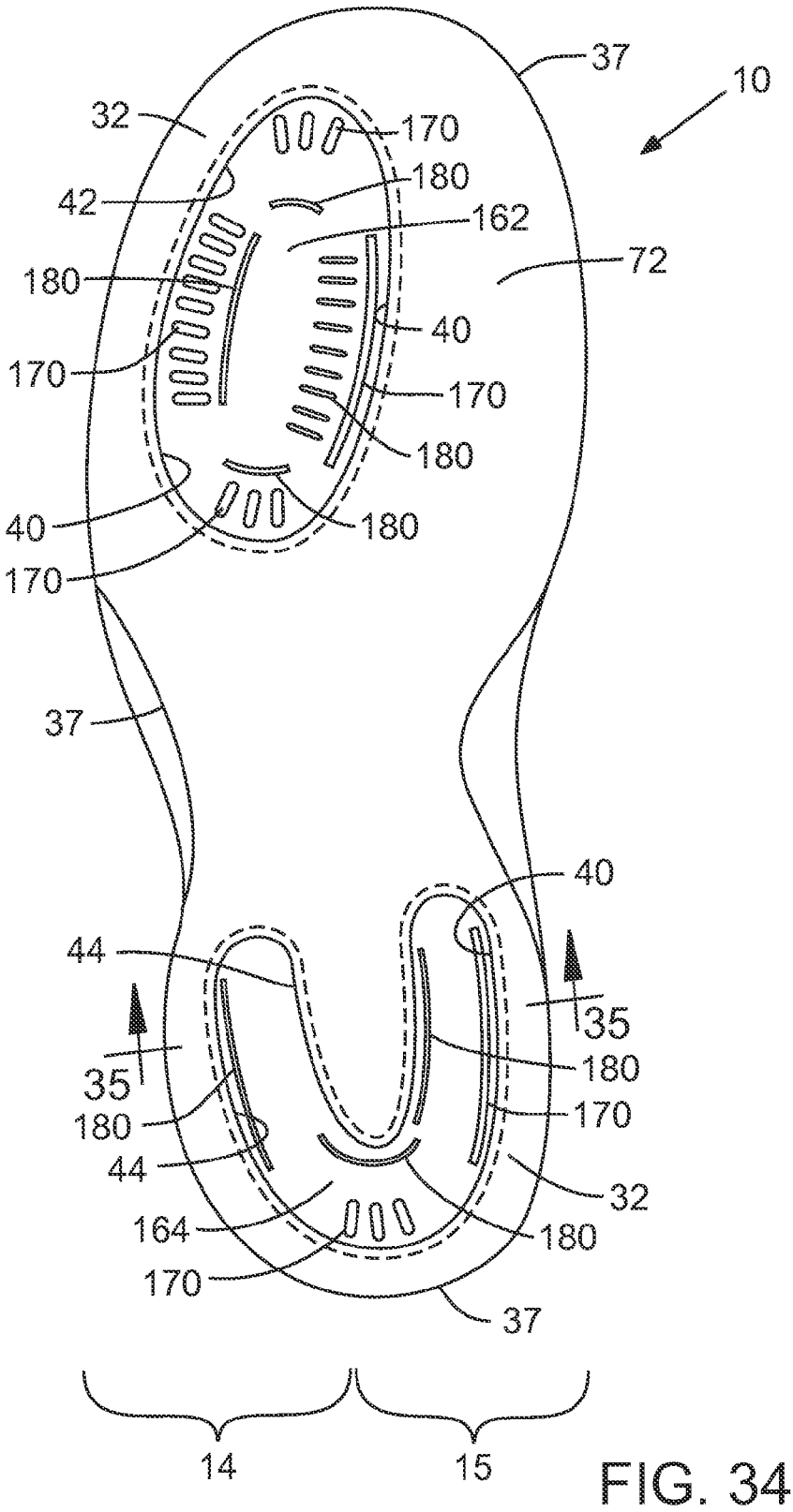
FIG. 34 is a bottom plan view corresponding with FIG. 27 and depicting a further configuration of the article of footwear.

In some configurations, insert elements 162 and 164 may have non-convex shapes. In an exemplary configuration depicted in FIGS. 34-35, an outer periphery of second insert element 164 has a non-convex shape, more specifically a horseshoe or U-shape. Second insert element 164 thus has a lateral portion on lateral side 14, a medial portion on medial side 15, and a rear portion connecting the lateral portion and the medial portion at the rear of heel region 13. Although depicted in FIGS. 34-35 as being contiguous, other configurations of sole structure 30 may incorporate distinct, non-continuous insert elements in the lateral portion, rear portion, and medial portion of heel region 13. Second insert element 164 has a circular or arcuate shape in cross-section, and this circular or arcuate shape may enhance weight-supporting and load-bearing properties of sole structure 30.

Figure 36:
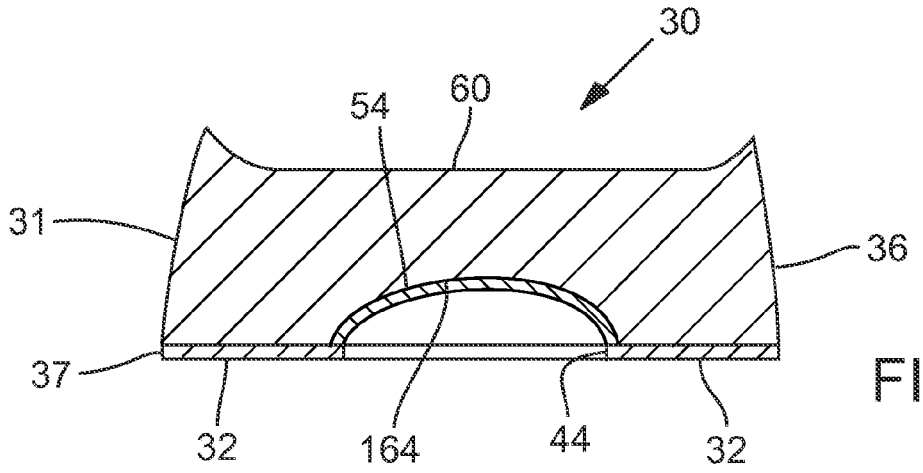
FIGS. 36-38 are cross-sectional views corresponding with FIG. 30 and depicting further configurations of the article of footwear.
Figure 37:
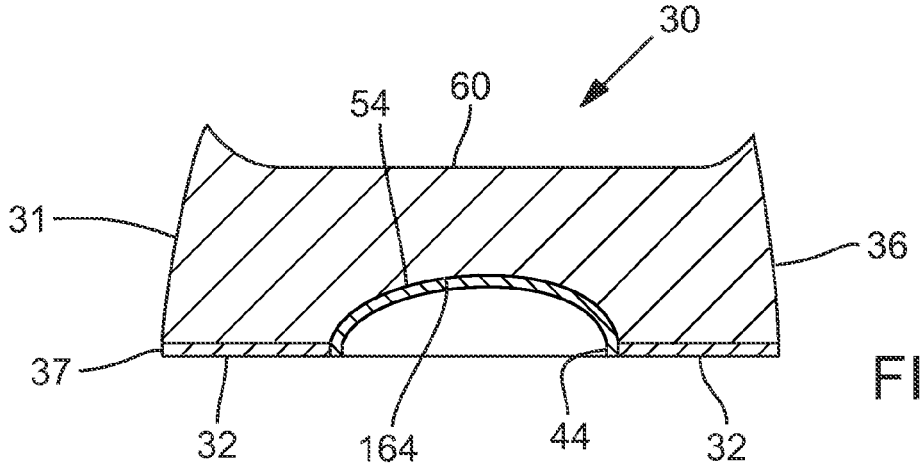

As depicted in FIG. 36, a peripheral edge of insert element 164 is larger than aperture 44. Accordingly, outsole 32 separates the peripheral edge of insert element 164 from the exterior of footwear 10. However, in some configurations, insert elements 160 may have peripheral edges smaller than the apertures 40 through which they are exposed. In the exemplary configuration depicted in FIG. 37, the peripheral edge of insert element 164 is exposed through aperture 44, and extends downward to be flush with the lower surface of outsole 32 and to form part of the ground-contacting surface of footwear 10.

Figure 38:
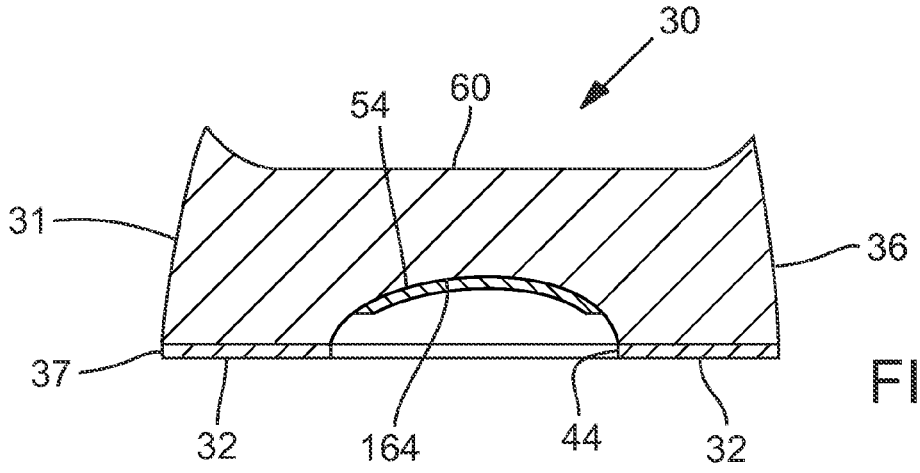

In other configurations, insert elements 160 may not cover all of arcuate recesses 50. FIG. 38 depicts a configuration in which the peripheral edge of second insert element 164 is separated from aperture 44, and aperture 44 exposes both insert element 164 and portions of recess 54 to the exterior of footwear 10.

Figure 39:
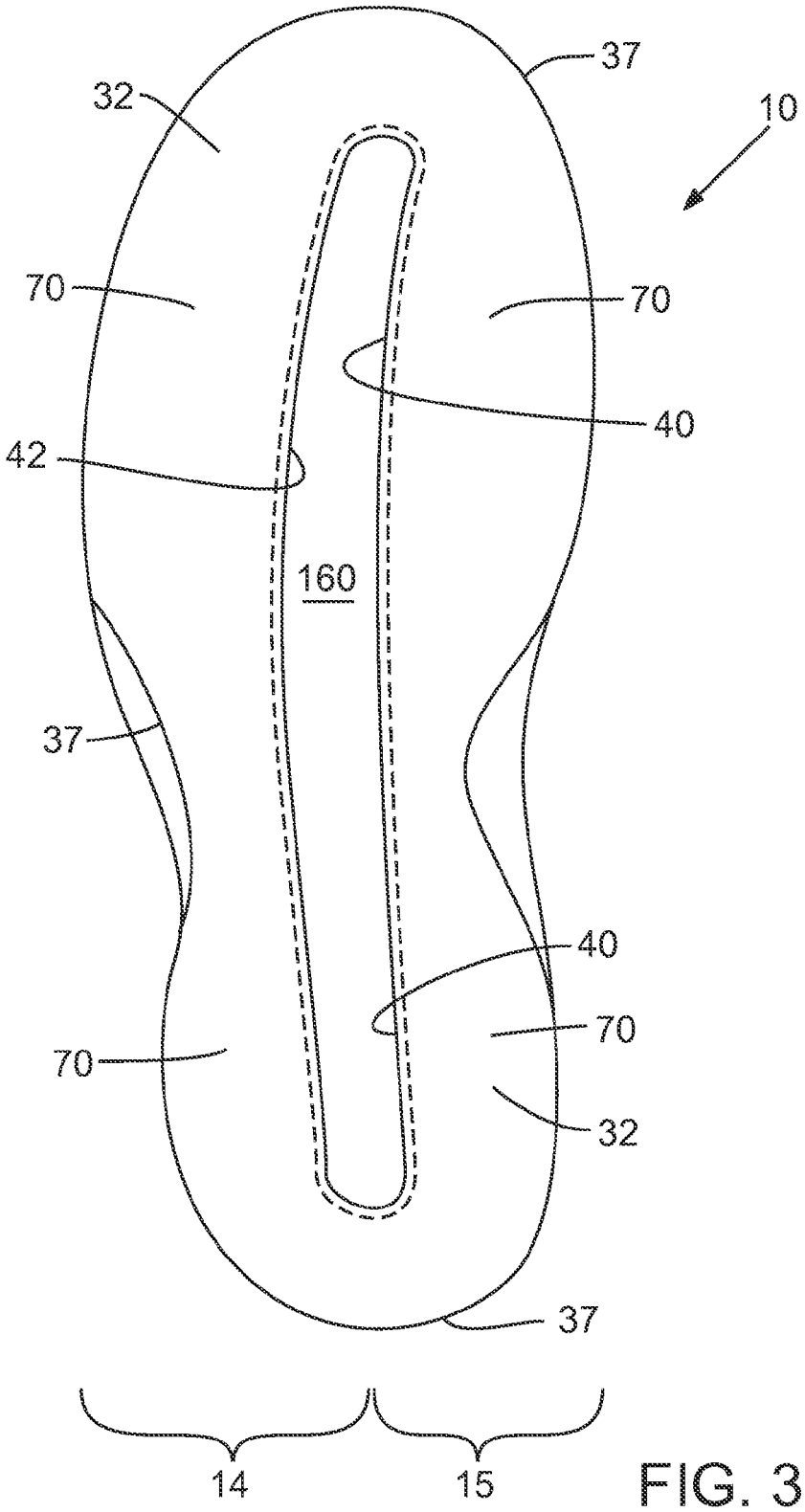
FIGS. 39-40 are bottom plan views corresponding with FIG. 27 and depicting further configurations of the article of footwear.
Figure 40:
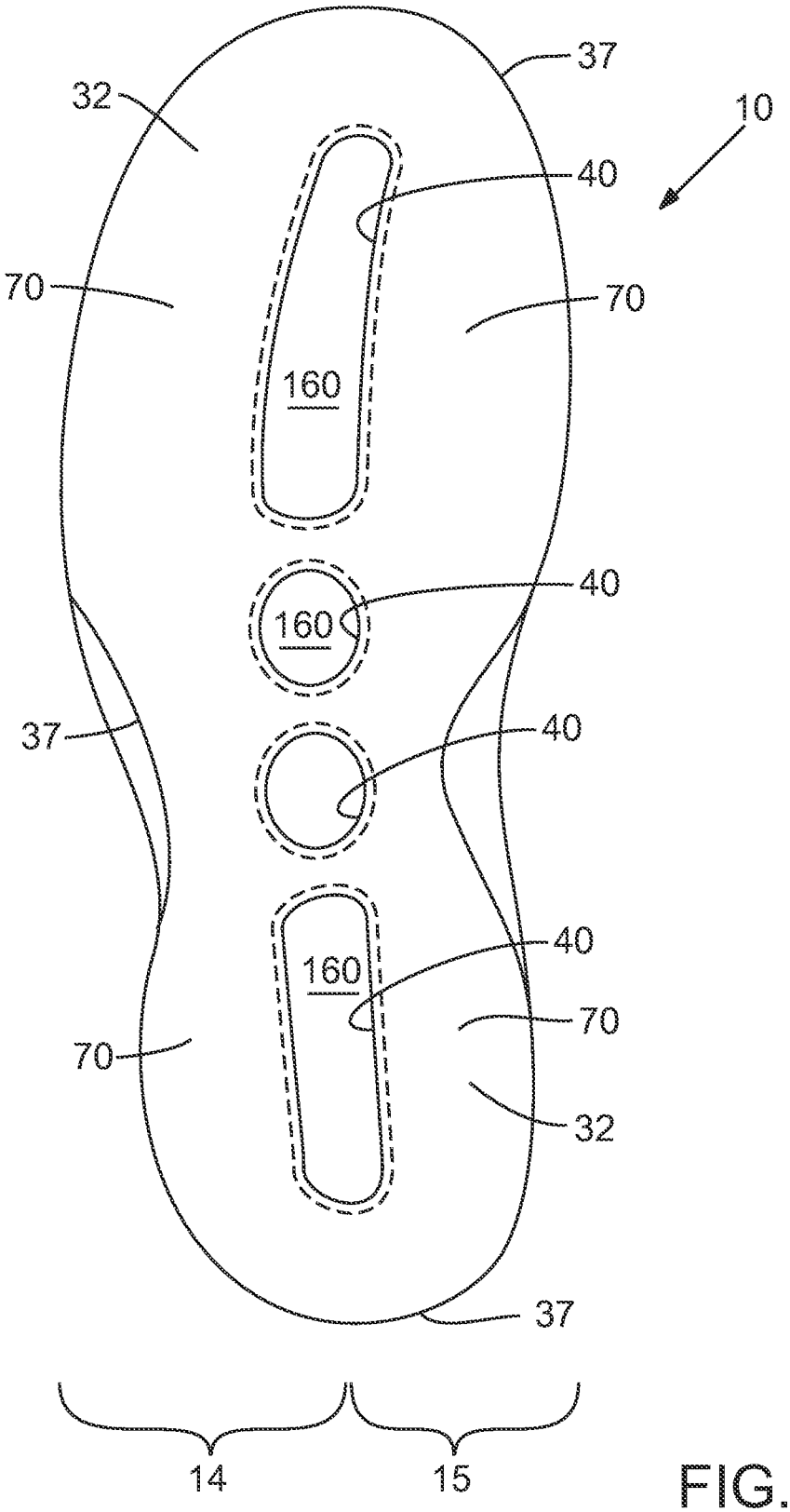

Although the non-uniform medio-lateral configuration of sole structure 30 is depicted in FIGS. 21-24 as being asymmetric, other configurations of sole structure 30 are possible. As depicted in FIG. 39, for example, insert element 160 may extend along a central portion of sole structure 30 from a forefoot region 11 to a heel region 13, and may have an arcuate cross-sectional configuration to provide support within sole structure 30. In this configuration, both lateral side 14 and medial side 15 include complementary regions 70, in which a thickness of midsole 31 is generally greater than a thickness of midsole 31 above insert element 160. FIG. 40 depicts a similar configuration in which multiple distinct, non-contiguous insert elements 160 extend along the central portion of sole structure 30, between forefoot region 11 and heel region 13.

The substantially symmetrical medio-lateral configuration of sole structure 30 in FIGS. 39 and 40 may allow sole structure 30 to respond in similar ways to lateral or banking movements to the left and to lateral or banking movements to the right.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear having a sole structure comprising a midsole with an arcuate underside recess, an arcuate insert element disposed entirely within the recess and secured to the midsole, and an outsole with an aperture, wherein the insert element is exposed to an exterior of the footwear through the aperture, and the outsole is secured to the midsole in a region wholly surrounding the insert element.

2. The article of footwear of claim 1, wherein the insert element is formed from a thermoplastic polyurethane material.

3. The article of footwear of claim 1, wherein the insert element includes a slot.

4. The article of footwear of claim 1, wherein the insert element includes an opening extending through a center of the insert element.

5. The article of footwear of claim 1, wherein the insert element includes a ridge.

6. The article of footwear of claim 1, wherein the insert element has an elongate shape.

7. The article of footwear of claim 6, wherein a length of the insert element is at least thirty percent of a length of the sole structure.

8. The article of footwear of claim 1, wherein the insert element is hemispherically-shaped.

9. The article of footwear of claim 1, wherein the insert element is positioned on a lateral side of the footwear.

10. The article of footwear of claim 1, wherein the insert element is positioned in a forefoot region of the footwear.

11. The article of footwear of claim 1, wherein the midsole further includes an additional arcuate underside recess positioned in a heel region of the footwear, the outsole further includes an additional aperture, and the sole structure further comprises an additional arcuate insert element that is (a) secured to the additional arcuate underside recess and (b) exposed to the exterior of the footwear through the additional aperture.

12. The article of footwear of claim 1, wherein the insert includes a peripheral edge and a concave lower surface extending from the peripheral edge, the peripheral edge engaging the outsole.

13. An article of footwear having an upper and a sole structure secured to the upper, the sole structure comprising:

a midsole having an upper surface and an opposite lower surface, the upper surface being secured to the upper, and the lower surface defining an inwardly-extending arcuate recess;

a plate secured to the midsole and disposed entirely within the recess such that the plate conforms to the recess, at least one opening extending through the plate to expose the midsole; and a ground-engaging outsole, an aperture extending through the outsole to expose the plate, and the outsole being secured to the midsole in a region wholly surrounding the recess.

14. The article of footwear of claim 13, wherein the plate is formed from a thermoplastic polyurethane material.

15. The article of footwear of claim 13, wherein an opening of the at least one opening extends through a center of the plate.

16. The article of footwear of claim 13, wherein a lower surface of the plate defines an outwardly-extending ridge.

17. The article of footwear of claim 13, wherein the plate includes a plurality of openings extending through the plate to expose the midsole, the plurality of openings being positioned adjacent to each other and extending in substantially the same direction.

18. The article of footwear of claim 17, wherein a lower surface of the plate defines a plurality of outwardly-extending ridges positioned adjacent to each other and extending in substantially the same direction.

19. The article of footwear of claim 13, wherein the plate has an elongated configuration, and a length of the plate is at least thirty percent of a length of the sole structure.

20. The article of footwear of claim 13, further comprising an additional plate, the lower surface of the midsole defining an additional inwardly-extending arcuate recess positioned in a heel region of the footwear, and the additional plate being secured to the midsole and conforming to the additional recess.

21. The article of footwear of claim 13, wherein the plate includes a peripheral edge and a concave lower surface extending from the peripheral edge, the peripheral edge engaging the outsole.

22. An article of footwear having an upper and a sole structure secured to the upper, the sole structure comprising:

a midsole secured to the upper, the midsole having a lower surface defining an upwardly-extending underside recess;

an arcuate plate secured to the lower surface and disposed entirely within the recess, the plate having a lower surface defining a protrusion; and a ground-engaging outsole secured to the midsole in a region wholly surrounding the recess, an aperture extending through the outsole to expose the plate.

23. The article of footwear of claim 22, wherein the arcuate plate is formed from a thermoplastic polyurethane material.

24. The article of footwear of claim 22, wherein a slot extends through the arcuate plate, and the midsole is exposed to an exterior of the article of footwear through the slot.

25. The article of footwear of claim 22, wherein the lower surface of the arcuate plate defines a plurality of protrusions positioned adjacent to each other and extending in substantially the same direction.

26. The article of footwear of claim 25, wherein a plurality of slots extend through the arcuate plate, the slots being positioned adjacent to each other and extending in substantially the same direction.

27. The article of footwear of claim 22, wherein an opening extends through a center of the arcuate plate, and the midsole is exposed to an exterior of the footwear through the opening.

28. The article of footwear of claim 22, wherein the arcuate plate has an elongated configuration, and a length of the plate is at least thirty percent of a length of the sole structure.

29. The article of footwear of claim 22, further comprising an additional arcuate plate, the lower surface of the midsole defining an additional upwardly-extending underside recess, and the additional arcuate plate being secured to the lower surface of the midsole within the additional recess.

30. The article of footwear of claim 22, wherein the arcuate plate includes a peripheral edge and a concave lower surface extending from the peripheral edge, the peripheral edge engaging the outsole.

* * * * *